US005532796A

United States Patent [19]

Narikawa et al.

[11] Patent Number: 5,532,796

[45] Date of Patent: Jul. 2, 1996

[54] IMAGE FORMING APPARATUS

[75] Inventors: Shiro Narikawa, Kashihara; Hirokazu Tanaka, Osaka; Iwakazu Honda, Kitakatsuragi-gun; Tomohiro Oikawa; Hiroe Ando, both of Chiba, all of Japan

[73] Assignee: Sharp Kabushiki Kaisha, Osaka, Japan

[21] Appl. No.: 433,604

[22] Filed: May 3, 1995

[30] Foreign Application Priority Data

May 11, 1994 [JP] Japan ..... 6-97410

[51] Int. Cl.[6] ..... G03G 15/00

[52] U.S. Cl. ..... 355/210; 355/200; 355/219; 355/245

[58] Field of Search ..... 355/200, 210, 355/211, 219, 220, 228, 229, 245, 251, 326 R, 327; 358/296, 300; 347/129

[56] References Cited

U.S. PATENT DOCUMENTS

| | | | |
|---|---|---|---|
| 4,804,994 | 2/1989 | Sasaki et al. | 355/251 |
| 5,053,821 | 10/1991 | Kunugi et al. | 355/245 |
| 5,159,389 | 10/1992 | Minami et al. | 355/211 |
| 5,172,163 | 12/1992 | Yamaoki et al. | 355/210 |
| 5,298,945 | 3/1994 | Wada et al. | 355/210 |

FOREIGN PATENT DOCUMENTS

| | | |
|---|---|---|
| 1-196076 | 8/1989 | Japan . |
| 2-083559 | 3/1990 | Japan . |
| 4-190369 | 4/1992 | Japan . |
| 4-138767 | 5/1992 | Japan . |

*Primary Examiner*—Sandra L. Brase
*Attorney, Agent, or Firm*—David G. Conlin; Brian L. Michaelis

[57] ABSTRACT

An image forming apparatus is arranged so as to include an optical head unit constituted of exposing device and information reading device, one cylindrical white light source which is commonly used as a light source for the above both devices, liquid crystal shutter arrays for individually opening and closing optical paths of the light source in direction of a photoreceptor, and to control open/close operation of an exposure shutter array according to an image signal and to control the shutter arrays such that when the exposing device operates, the information reading shutter array closes and that when the information reading device operates, the exposure shutter array closes. As a result, in an arrangement which is carried out a simultaneous charge-expose-development process and has exposing function and information reading function, it is possible to sufficiently miniaturize an apparatus. Moreover, since the liquid crystal shutter array is used, open/close operation of the optical paths from the cylindrical white light source to the photoreceptor can be easily and securely control.

19 Claims, 25 Drawing Sheets

(OPEN STATE)

(STOPPED-DOWN STATE)

IMAGE FORMING APPARATUS

FIELD OF THE INVENTION

The present invention relates to an image forming apparatus, such as a copying apparatus, a printer, a facsimile, which exposes an image carrier having a transparent conductive layer from an inside of the image carrier on an opposite side to a developing section side.

BACKGROUND OF THE INVENTION

Conventionally, an electrophotographic process used in a copying apparatus or a printer is superior to the other image forming processes in a high speed, a high quality of an image and a capability of recording on plain paper, so this process has been generally and widely in common use.

Meanwhile, in recent years, a digital technique of the electrophotographic process has made progress and it is attracting attention. This technique is developed so that a copying apparatus can perform functions which cannot be performed by an analog copying apparatus. The functions are such that the digital copying apparatus can be connected to a facsimile or a computer, can edit and process an image.

In addition, as to a facsimile, thermal recording system using a thermal head and thermal paper is dominant in these days because of its low price and small size. However, since the thermal recording does not provide service life and stability of recording paper, the aforementioned conventional electrophotographic process which is capable of recording on plain paper is used for a certain purpose. Moreover, a facsimile printer which adopts the aforementioned digital technique into the thermal recording system has been developed. A schematic drawing of this apparatus is shown in FIG. 21.

The above apparatus includes a printer section which is an image forming section and a controlling section 318 for controlling input/output of information. The printer section have an information input section 311 composed of an image sensor such as CCD, a photoreceptor 312, a charging section 313 for uniformly charging the photoreceptor 312, an exposing section 314 for writing information to the photoreceptor 312, a developing section 315 for developing an electrostatic latent image, which has been formed on the photoreceptor 312 by exposure, using a developer, a transfer section 316 for transferring a developed image onto recording paper 319, and a cleaning section 317 for removing the developer which remains on a surface of the photoreceptor 312.

However, since in the conventional electrophotographic process, a corona charger is used for charging and transfer processes, ozone is generated. The ozone is harmful to not only humans but also service life of a photoreceptor, etc. Moreover, since the electrophotographic process is complicated, there exists a limit to miniaturization lowering of cost.

Therefore, as one of methods of solving these problems, a new recording process without corona charge is suggested in the Journal of Japan Society of Electrophotography, Volume 30, No. 3 (1991), p.323. This method makes it possible to simplify an image forming process and to miniaturize an apparatus by simultaneously carrying out charge, exposure and development. The following will describe this method.

As shown in FIG. 22, in the simultaneous charge-exposure-development (SCED) process, a photoreceptor 301 where a transparent conductive layer 301*b* and a photoconductive layer 301*c* are formed in this order on a transparent base 301*a* such as glass is used. In image forming, when a toner layer, which is composed of conductive magnetic toner (hereinafter, referred to as toner) ta, contacts with a surface of the photoreceptor 301, and a developing bias 303 is applied to an electrically conductive sleeve 302*a* of a developing roller 302, the toner layer has a potential which is same as the developing bias 303. In other words, in a position where the photoconductive layer 301*c* begins to contact with the toner layer, a surface potential of the photoconductive layer 301*c* is lower than the developing bias 303. Thereafter, charges are injected into the photoconductive layer 301*c* through the toner ta which adheres to a surface of the photoconductive layer 301*c*. Moreover, toner ta, which successively carried by rotation of a magnetic roller 302*b* of the developing roller 302, collide with the toner ta adhering to the photoconductive layer 301*c*, and the adhering toner ta leaves from the photoconductive layer 301*c*. Due to repetition of such movements, the surface potential of the photoconductive layer 301*c* becomes substantially same as the developing bias 303.

Therefore, even in a position where the toner layer lies apart from the photoconductive layer 301*c*, the surface of the photoconductive layer 301 has a substantially same potential as the developing bias 303. For this reason, the toner ta in the above position is attracted to the developing roller 302 side by magnetic force of the magnetic roller 302*b*. Meanwhile, when a light 304 is irradiated to the toner ta so that the photoreceptor 301 is exposed through the transparent base 301*a* just before the toner ta leaves from the photoconductive layer 301*c*, photo-exited carriers generated in the photoconductive layer 301*c* move to the surface of the photoconductive layer 301*c* and are neutralized with the surface charges. The surface potential of the photoconductive layer 301*c* is lowered due to the neutralization, and the charged toner ta adheres to the photoconductive layer 301*c* so as to cover the lowered potential. Since the toner ta adhering to the photoconductive layer 301*c* immediately leaves from the developing roller 302 in this position, there is not time for charging the photoconductive layer 301*c* through the toner ta. Therefore, in the above position, electric attraction becomes stronger than magnetic attraction by the magnetic roller 302*b*, thereby making it possible to obtain a visible image of toner on the surface of the photoreceptor 301.

A concrete apparatus adopting the aforementioned SCED process is disclosed Japanese Laid-Open Patent Publication 4-138767/1992. As shown in FIGS. 23 and 24, this apparatus is provided with a print head 332 and a image sensor 334 in a transparent photoreceptor drum 331 composed of a transparent electrode and a photoconductive layer. The print head 332 uses a light emitting diode or a laser, and the image sensor 334 consists of the light emitting diode to irradiate a light on a document 333 and a photoconductive device to read its reflected light.

In addition, in order to achieve space saving, Japanese Laid-Open Patent Publication 2-83559 discloses that a printer adopting the SCED process is provided with an aperture-type light source which is used as an exposing section and with functions in exposing and eliminating charges. As shown in FIG. 25, its arrangement is such that a fluorescent lamp 341 is used as the light source, a liquid crystal array panel 342 and a focusing lens 343 are used as the exposing section and that charges are eliminated from a photoreceptor 345 through an aperture 344. Moreover, in order to increase light availability, a movable reflecting plate 346 is provided on a surface of the fluorescent lamp 341.

In addition, Japanese Laid-Open Patent Publication 1-196076/1989 discloses an apparatus where as a developer, photoconductive toner is used in the SCED process instead of conventional dry toner. As shown in FIG. 26, in this apparatus, not a conventional photoreceptor but an image carrier 351 where a transparent dielectric layer is formed on a transparent base is used and an image is formed by photoconductive magnetic toner 352.

Furthermore, Japanese Laid-Open Patent Publication 4-190369/1992 discloses coloring of a formed image in the SCED process which uses photoconductive toner. As shown in FIGS. 27(*a*) and 27(*b*), its arrangement is such that (1) an image carrier 361 where a transparent conductive layer and a photoconductive layer are formed on a transparent carrier, (2) a white light source 362, (3) a shutter for forming image 363, (4) filters for selecting wavelength 364*y*, 364*m*, 364*c* and 364*b*, (5) respective photoconductive toner for yellow, magenta, cyan and black, and (6) developer vessels 365*y*, 365*m*, 365*c* and 365*b* which individually contain the photoconductive toner for each color are provided, and that a color image is obtained by allowing an exposing section 366 to rotate until the exposing section 366 comes towards the filters for selecting wavelength 364*y*, 364*m*, 364*c* and 364*b* to be used.

An image forming process using the photoconductive toner is described in 9th International Congress on Advances in Non-Impact Print Technologies/Japan Hardcopy 1993, p.189. In this process, photoconductive toner composed of zinc oxide showing persistent photoconductivity, and instead of the SCED process, similarly to the conventional electrophotographic process, exposure is performed from an outside of an image carrier. The above process will be explained referring to FIG. 28. Photoconductive toners, which are negatively charged by mixing with carrier beads in a development unit 372, are uniformly deposited on a surface of a metal drum 371 as a thin layer and a light is irradiated thereon by an exposing section 373. As a result, an exposed portion of the toner layer gradually discharges charges due to absorption of the light and becomes low resistance states, but an unexposed portion maintains a initial charges. Here, when a negative bias is applied to a transfer roller 374, an effective charge injection occurs from a metal drum 371 to the exposed portion. With this injection, the polarity of toner charge converts to the opposite sign so that the exposed portion is transferred onto a sheet 375. In such a manner, an image is formed.

In the above-mentioned image forming process using the photoconductive toner, dry photoconductive toner is used, but a wet-system image forming process where photoconductive toner is dispersed in insulating liquid has been conventionally known. This process is described in, for example, J.Appl. Photo. Eng. 8 (1982), p.256. However, this process is not an SCED process either. The process will be explained referring to FIG. 29. A thin coating layer of photoconductive toner is applied to a Mylar belt 382 by an ink unit 381, and the photoconductive toner is negatively charged by a corotron 383 as pre-charging. Next, the photoconductive toner layer is carried to a metal drum 384. Here, positive charges are applied to the photoconductive toner by a corotron 385 on an inner side of the Mylar belt 382 and at the same time that the photoconductive toner is exposed by a laser head 386. As to the exposed photoconductive toner, its polarity is reversed by charge injection due to absorption of the light so that the photoconductive toner moves towards the metal drum 384. A negative image is obtained on the metal drum 384 and a positive image on the Mylar belt 382. Thereafter, the toner image on the metal drum 84 is transferred onto paper 387.

As mentioned above, in the image forming apparatus adopting the SCED process, since a corona charger is not used for charging and transferring process, ozone is not generated. Moreover, since an image forming process is simple and an exposing unit is positioned on an opposite side of a developing unit side to an image carrier for forming an image of a developer, space can be effectively utilized and an apparatus can be miniaturized. This becomes particularly remarkable in the case where a drum-like or endless belt-like image carrier is used because the exposing unit can be positioned inside the drum-like or the endless belt-like image carrier.

However, as to the arrangements shown in FIG. 23 or FIG. 24, since a print head 332 and an image sensor 334 for exposure are provided inside a transparent photoreceptor drum 331, an apparatus is miniaturized, but the print head 332 and the image sensor 334 for exposure are isolated respectively, so a light source is required for each. For this reason, miniaturization of an apparatus is not sufficiently attained.

In addition, in the arrangement shown in FIG. 25, although the exposing section has functions in exposing the photoreceptor 345 and eliminating charges from the photoreceptor 345, an arrangement having a function in reading a document image is not considered. Moreover, miniaturization of an apparatus is not sufficiently considered. Furthermore, since the aperture for exposure of the photoreceptor 345 and the aperture 344 for charge eliminating of the photoreceptor 345 are mechanically opened and shut by the movable reflecting plate 346, it is not easy to control driving of the movable reflecting plate 346, and also perfect shading in the above apertures is difficult. Moreover, since the movable reflecting plate 346 requires a mechanical driving structure, a size of an apparatus becomes large.

In addition, in the arrangement shown in FIG. 26, miniaturization of an apparatus is not considered. Moreover, in the arrangement shown in FIGS. 27(*a*) and 27(*b*), similarly to the arrangement shown in FIG. 25, an arrangement having a function in reading a document image is not considered, and also miniaturization of an apparatus is not sufficiently considered. Here, since a color image is obtained by rotating the exposed portion 366, it is necessary to precisely control a position of the exposed portion 366, and this control is difficult. Moreover, a driving mechanism for rotating the exposed portion 366 is required, so a size of an apparatus becomes large.

Needless to say, since the arrangements shown in FIGS. 28 and 29 are not a process using the SCED process, miniaturization of an apparatus cannot be desired.

As mentioned above, with the above-mentioned conventional arrangements, there arises a problem that miniaturization of an image forming apparatus cannot be sufficiently attained.

SUMMARY OF THE INVENTION

It is an object of the present invention to provide an image forming apparatus which can be sufficiently miniaturizing with an arrangement adopting an SCED process.

In order to achieve the above object, the image forming apparatus adopting the SCED process of the present invention includes:

(1) an image carrier formed such that at least a transparent conductive layer is formed on a transparent base;

(2) developing means for supplying a developer to a surface of a transparent conductive layer side of the image carrier, the developing means being provided on the transparent conductive layer side of the image carrier;

(3) an optical head unit provided on a transparent base side of the image carrier; and (4) control means for controlling an operation of the optical head unit. The optical head unit includes exposing means for irradiating a light around the developer supplied position from the transparent base side of the image carrier, which is provided oppositely to the developing means across the image carrier and information reading means for irradiating a light on a document positioned on the transparent conductive layer side so as to read a document image using a reflected light from the document. The exposing means are integral with the information reading means. The optical head unit includes a common light source which is commonly used as a light source to the above two means, a first liquid crystal shutter array for opening and closing an optical path of the common light source in direction of the image carrier so that the light of the common light source is used as a light of the exposing means and a second liquid crystal shutter array for opening and closing the optical path of the common light source in the direction of the image carrier so that the light of the common light source is used as a light of the information reading means. Moreover, the control means controls open/close operation of the first liquid crystal shutter array of the exposing means according to an image signal, and controls the first and second liquid crystal shutter arrays so that the second liquid crystal shutter array of the information reading means is closed when the exposing means operates and that the first liquid crystal shutter array of the exposing means is closed when the information reading means operates.

With the above arrangement, the exposing means and the information reading means constitute the optical head unit, and one light source is commonly used for the above both means. Moreover, the liquid crystal shutter arrays for opening and closing the optical paths of the common light source in direction of the image carrier is respectively provided. For this reason, in an arrangement that an SCED process is adopted and the optical head unit has exposing function and information reading function, it is possible to sufficiently miniaturize an apparatus. Moreover, since both the exposing means and the information reading means use the liquid crystal shutter array as means for opening and closing optical paths of the common light source in the direction of the image carrier, it is possible to control the open/close operation of the light paths easily and securely.

With the above arrangement, the optical head unit further includes charge eliminating means for eliminating charges by irradiating a light on the image carrier. It is desirable that this charge eliminating means also constitutes the optical head unit together with the exposing means and information reading means. In this case, the common light source is commonly used also as a light source for the charge eliminating means and a third liquid crystal shutter array for opening and closing the optical paths of the common light source in the direction of the image carrier is provided in order that the light from the common light source is used as a light for the charge eliminating means. The control means is arranged so as to control the liquid crystal shutter arrays so that when the information reading means operates, the third liquid crystal shutter array of the charge eliminating means also closes together with the first liquid crystal shutter array.

With the above arrangement, not only the exposing means and the information reading means but also the charge eliminating means constitute the optical head unit, and the one common light source is commonly used as a light source for the three means, thereby making it possible to further miniaturize an apparatus.

In addition, it is desirable that the information reading means is arranged so as to include a filter for transmitting only a light, hardly absorbed in the image carrier, which is provided on the optical paths of the common fight source in the direction of the image carrier. As a result, since a light irradiated from the common light source to the direction of the image carrier is hardly absorbed in the image carrier, the information reading means can read information accurately.

It is another object of the present invention to provide an image forming apparatus which can improve quality of a formed image without causing rise in cost in the arrangement that the SCED process is adopted.

In order to achieve the above object, the image forming apparatus adopting the SCED process of the present invention includes:

(1) an image carrier formed cylindrically such that at least a transparent conductive layer is formed on a transparent base;

(2) developing means for supplying a developer to the surface of the image carrier, the developing means being provided outside the image carrier;

(3) exposing means for irradiating a light around the developer supplied position from inside of the image carrier, the exposing means being provided inside the image carrier; and (4) control means for controlling an operation of the exposing means. The exposing means includes a cylindrical light source provided at an axis position where the image carrier rotates and a two-dimensional liquid crystal shutter array having an curved surface and extended along an inner peripheral surface of the image carrier. Moreover, the control means controls open/close state of each liquid crystal cell of the two-dimensional liquid crystal shutter array according to an image signal.

With the above arrangement, since the exposing means includes the cylindrical light source provided in the central position where the image carrier rotates and the two-dimensional shutter array which is curved like an arc along the inner peripheral surface of the image carrier and is extended in the inner peripheral direction, quality of an image can be improved without causing rise in costs.

In other words, in the case where the two-dimensional liquid crystal shutter array is plain, a distance from a central portion of the two-dimensional liquid crystal shutter array to an inner surface of the image carrier are different from a distance from an end of the two-dimensional liquid crystal shutter array to the inner surface of the image carrier in direction in which the cylindrical image carrier rotates. For this reason, since a spot diameter on the image carrier of a light which has passed through the central portion of the two-dimensional liquid crystal shutter array is different from a spot diameter of a light which has passed through the end portion of the two-dimensional liquid crystal shutter array, there is possibility of remarkable deterioration in quality of an image. In order to solve this problem, compensation by an optical system, etc. for equalizing the spot diameters is required, thereby arising a problem of rise in costs. On the contrary, with the arrangement of the image forming apparatus of the present invention, since the distance from the center of the two-dimensional liquid crystal shutter array to the inner surface of the image carrier is equal to the distance from the end portion of the two-dimensional liquid crystal shutter array to the inner surface of the image carrier, there does not arise the above problem. Therefore, quality of an image can be improved without causing rise in costs.

In addition, in the image forming apparatus of the present invention, since the exposing means includes the two-dimensional liquid crystal shutter array, not only process speed can be greatly improved but also resolution in vertical scanning direction, that is, the paper transporting direction, can be improved very easily.

In other words, in the case where an one-dimensional liquid crystal shutter array is used instead of the two-dimensional liquid crystal shutter array, since there exist only one row of liquid crystal cells in the vertical scanning direction which is a rotating direction of the image carrier, complicated control is required in order to obtain excellent resolution in the vertical scanning direction, and furthermore, there are limitations of improvement in the resolution. On the contrary, in the case where the two-dimensional liquid crystal shutter array is used, since a plurality of liquid crystal cells exist in the vertical scanning direction, control for obtaining excellent resolution in the vertical scanning direction is easy, and its process speed can be greatly improved.

In addition, in the image forming apparatus of the present invention, an area which is not opposed to the two-dimensional liquid crystal shutter array can be used as a charge eliminating area of the image carrier or the cleaning area of the image carrier.

For a fuller understanding of the nature and disadvantages of the invention, reference should be made to the ensuing detailed description taken in conjunction with the accompanying drawings.

BRIEF DESCRIPTION OF THE DRAWINGS

FIG. 1 is a schematic front view which shows an arrangement of an image forming apparatus in one embodiment of the present invention.

FIG. 2 is a schematic block diagram which shows an arrangement a control system which is provided in the image forming apparatus of FIG. 1.

FIG. 3 is a schematic front view which shows an arrangement of an image forming apparatus in another embodiment of the present invention.

FIG. 4 is a schematic front view which shows an arrangement of an image forming apparatus in still another embodiment of the present invention.

FIG. 5 is a schematic block diagram which shows an arrangement of a control system which is provided in the image forming apparatus of FIG. 4.

FIG. 6 is a schematic front view which shows an arrangement of an image forming apparatus in still another embodiment of the present invention.

FIG. 7 is a schematic block diagram which shows an arrangement of a control system which is provided in the image forming apparatus of FIG. 6.

FIG. 8 is a schematic front view which shows an arrangement of an image forming apparatus in still another embodiment of the present invention.

FIG. 9 is a schematic block diagram which shows an arrangement of a control system which is provided in the image forming apparatus of FIG. 8.

FIG. 10 is a schematic front view which shows an arrangement of an image forming apparatus in still another embodiment of the present invention.

FIG. 11 is a schematic block diagram which shows an arrangement of a control system which is provided in the image forming apparatus of FIG. 10.

FIG. 12 is a schematic front view which shows a photoreceptor, a developer unit, an exposing unit and a dielectric belt of an image forming apparatus in still another embodiment of the present invention.

FIG. 13 is a schematic front view which shows an overall arrangement of the image forming apparatus.

FIG. 14 is an explanatory drawing which shows a state where a surface of the photoreceptor is charged by contact with conductive magnetic toner.

FIG. 15 is a perspective view which shows the photoreceptor and a charge eliminating unit provided inside the photoreceptor.

FIG. 16 is a disassembly perspective view which shows an arrangement of an aperture narrowing-down cell provided in the exposing means.

FIG. 17 is a waveform diagram of each driving signal to be applied to the aperture narrowing-down cell.

FIG. 18(*a*) is an explanatory drawing which shows a voltage distribution in the aperture narrowing-down cell.

FIG. 18(*b*) is an explanatory drawing of the aperture narrowing-down operation by the voltage distribution shown in FIG. 18(*a*).

FIG. 19(*a*) is an explanatory drawing which shows an open state of the aperture in the aperture narrow-down cell.

FIG. 19(*b*) is an explanatory drawing which shows a state of a narrowed-down state of the aperture in the aperture narrowing-down cell.

FIG. 20 is an explanatory drawing which shows an area set on the photoreceptor and a control unit of an exposing unit.

FIG. 21 is an explanatory drawing which shows an arrangement of a facsimile printer which is capable of recording on conventional plain paper.

FIG. 22 is an explanatory drawing of an image forming operation using a back surface recording process and conductive magnetic toner.

FIG. 23 is a schematic front view of a conventional image forming apparatus using a back surface recording process and conductive magnetic toner.

FIG. 24 is a schematic front view which shows another example of the above image forming apparatus.

FIG. 25 is a schematic front view of another conventional image forming apparatus using an SCED process and conductive magnetic toner.

FIG. 26 is a schematic front view of a conventional image forming apparatus using an SCED process and photoconductive magnetic toner.

FIG. 27(*a*) is a schematic front view of a conventional image forming apparatus which is capable of forming a color image using an SCED process and photoconductive magnetic toner.

FIG. 27(*b*) is an explanatory drawing which shows a developed portion in FIG. 27(*a*).

FIG. 28 is an explanatory drawing of a dry image forming process using the photoconductive toner.

FIG. 29 is an explanatory drawing of a wet image forming process using the photoconductive toner.

DESCRIPTION OF THE EMBODIMENTS

[EMBODIMENT 1]

Figure 1:
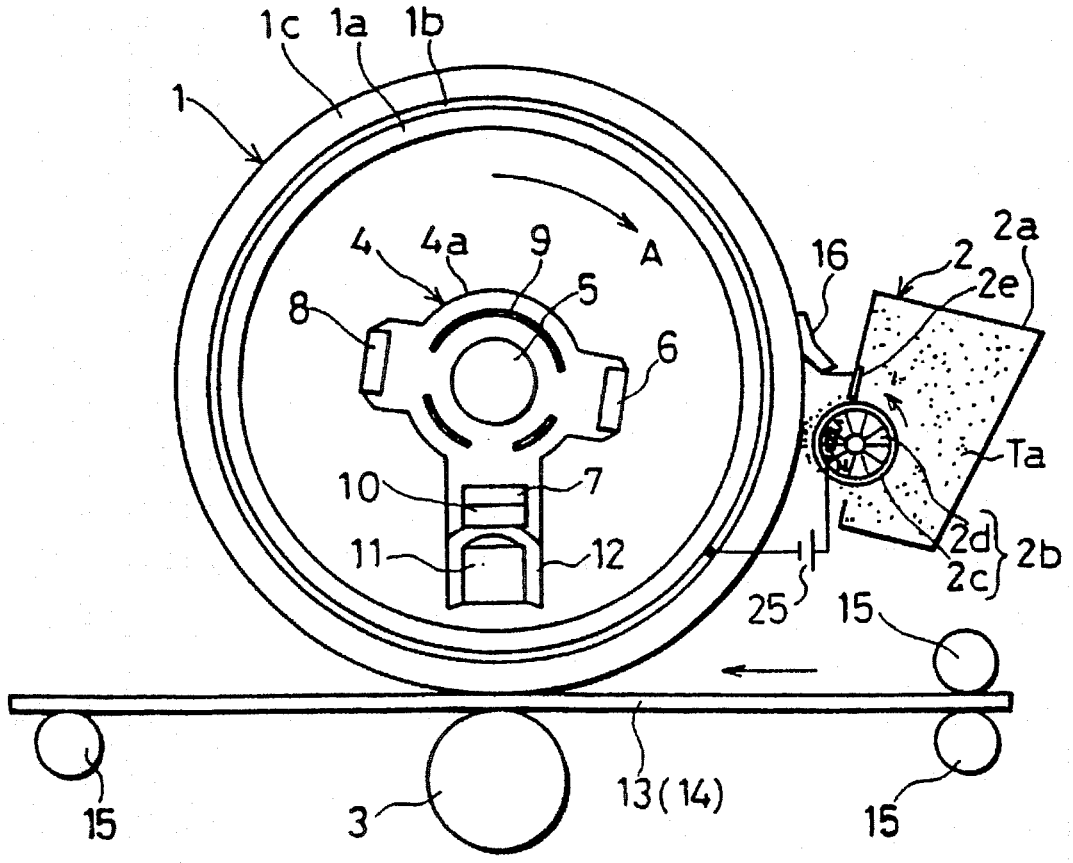
FIGS. 1 through 20 is a drawing which shows embodiments of the present invention.
Figure 2:
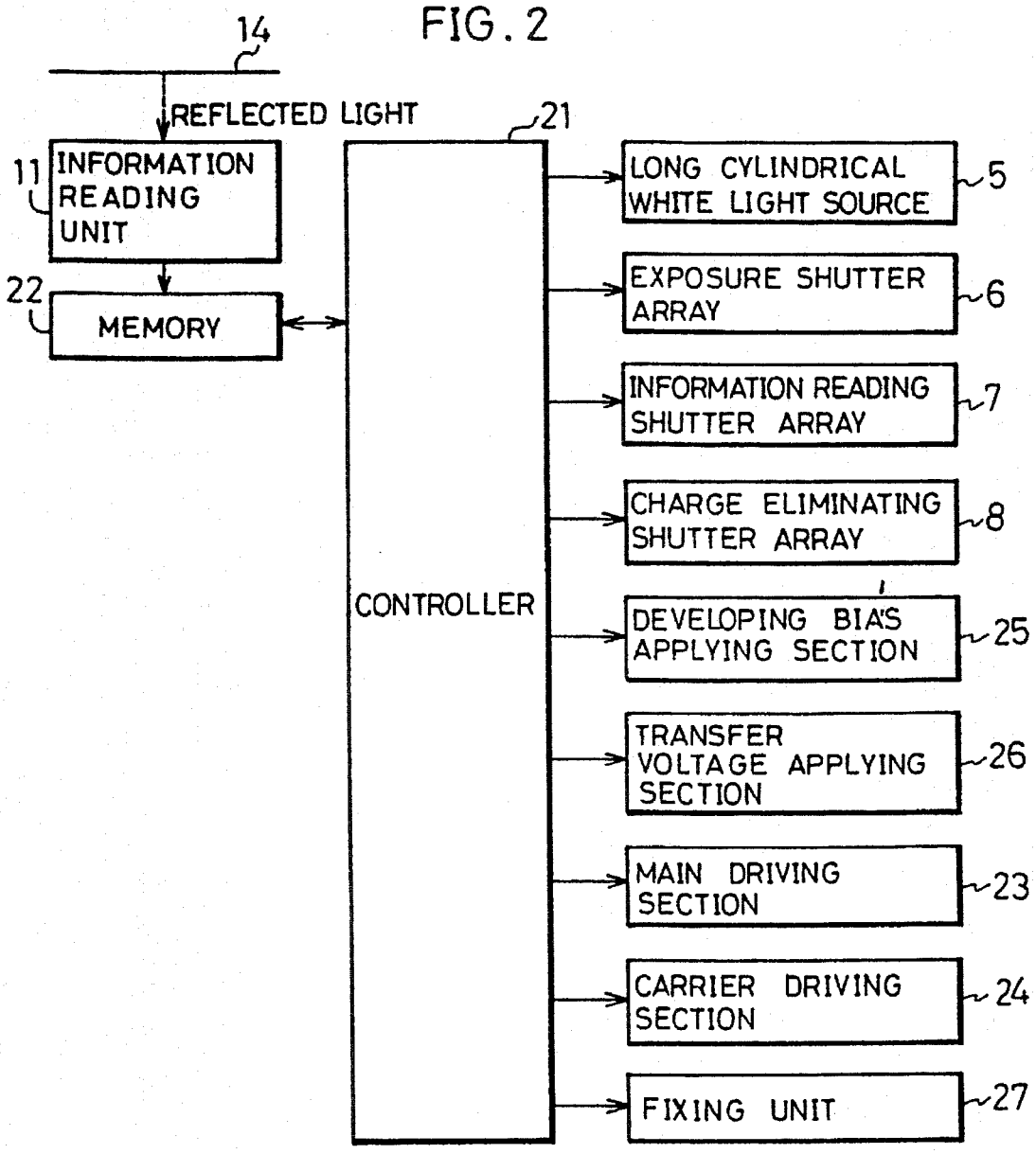

The following will discuss embodiment 1 of the present invention referring to FIGS. 1 and 2.

In the embodiment 1, and embodiments 2 through 6, described later, an image forming apparatus of the present invention is applied to a digital facsimile, for example. The image forming apparatus includes a photoreceptor 1 which is a cylindrical image carrier, a developer unit 2 and a transfer roller 3 which are positioned on a peripheral surface of the photoreceptor 1, and an optical head unit 4 which is positioned in the photoreceptor 1.

The photoreceptor 1 is arranged so that a transparent conductive film 1*b* and a photoconductive layer 1*c* are formed on a surface of a cylindrical transparent carrier 1*a* having light transmitting characteristics in this order. In the present embodiment, the transparent conductive film 1*b* in which an ITO film of 500 A thick and a $SnO_2$ film of 500 A thick are formed is used. Moreover, the photoconductive layer 1*c* in which (1) a blocking layer composed of a hydrogenated amorphous (a-Si:H) film with a thickness of 0.2 μm to which boron of 5000 ppm is added and (2) a photoconductive layer composed of an a-Si:H film with a thickness of approximately 3 μm to which boron of 5 ppm is Added and (3) a surface protecting layer composed of an a-SiC:H film with a thickness of 0.1 μm are formed is used.

The developer unit 2 is provided beside the photoreceptor 1, and conductive magnetic toner Ta is used as a developer. The conductive magnetic toner Ta is composed of powder, which is obtained such that after magnetic particles such as iron powder and ferrite, carbon black, etc. are added to resin composed of styrene-acrylic copolymer, etc., for example, the mixture is kneaded and broken into pieces so that each size becomes from several μm to dozens μm. After the conductive magnetic toner Ta is agitated by an agitating roller, not shown, which is provided in a developer vessel 2*a* and is fed on a developing sleeve 2*c* of the developing roller 2*b*, a thickness of a layer of the conductive magnetic toner Ta is controlled by a doctor blade 2*e*, and the conductive magnetic toner Ta is carried to a developing position. The developing roller 2*b* lies along axial direction of the photoreceptor 1, and the developing sleeve 2*c* is provided in a circumference of a magnetic roller 2*d* where an alternating field is generated by rotation of the magnetic roller 2*d*. The magnetic roller 2*d* is arranged such that magnets with N pole and magnets with S pole are alternatively positioned in circumferential direction, and the developing sleeve 2*c* is composed of non-magnetic aluminum or martensite-series stainless steel, for example. Here, a cleaning blade 16 for removing residual toner from the surface of the photoreceptor 1 is provided in the developer vessel 2*a*.

The transfer roller 3 is positioned below the photoreceptor 1, and it transfers a toner image formed on the surface of the photoreceptor 1 onto paper 13 only when the toner image is written to the paper 13 which is a recording medium for transferring of a toner image. The paper 13 is carried between the photoreceptor 1 and the transfer roller 3 by a plurality of carrying roller 15 . . . . Meanwhile, at the time of reading information from a document 14 which is a recording medium where a document image for reading has been recorded, instead of the paper 13, the document 14 is carried between the photoreceptor 1 and the transfer roller 3.

The optical head unit 4 has a cylindrical white light source 5, an exposure shutter array 6, an information reading shutter array 7, a charge eliminating shutter array 8, a light blocking member 9, a filter 10, an information reading unit 11 and an optical fiber array 12. In the present embodiment, the cylindrical white light source 5, the light blocking member 9 and the exposure shutter array 6 constitute exposing means. The cylindrical white light source 5, the light blocking member 9, the image reading shutter array 7, the filter 10 and information reading unit 11 constitute information reading means. The cylindrical white light source 5, the light blocking member and the charge eliminating shutter array 8 constitute charge eliminating means.

The cylindrical white light source 5 is composed of a halogen lamp, for example, and it is provided at an axial center of the photoreceptor 1. The exposure, information reading and charge eliminating shutter arrays 6 through 8 are provided on the circumference of the cylindrical white light source 5. The exposure shutter array 6 is provided in an opposite position of the developing roller 2*b*, the information reading shutter array 7 in an opposite position of the transfer roller 3 and the charge eliminating shutter array 8 in a substantially opposite array of the exposure shutter array 6 across the cylindrical white light source 5. These shutter arrays 6 through 8 are composed of a liquid crystal shutter array, and have a cellphoc lens array (not shown) and dust-proof glass (not shown) on its front surface. The light blocking member 9 covers around the cylindrical white light source 5 so that a light of the cylindrical white light source 5 is irradiated only on the shutter arrays 6 through 8.

The filter 10 is provided on the the transfer roller 3 side of the information reading shutter array 7. The filter 10 is composed of an interference filter with central wavelength of 800 nm and a sharp cut filter (transmission threshold wavelength: 480 nm). In the present embodiment, an optical band gap of the a-Si:H film which is used as the photoconductive layer 1*c* is 1.75 eV (wavelength is substantially 710 nm), and although a light whose energy is less than the band gap (a light with long wavelength of substantially 710 nm) is absorbed in the photoconductive layer 1*c* by transition between localized states, its absorption coefficient is very small, so the a-Si:H film mostly transmits a light. Therefore, the light whose energy is less than the band gap may be selected by using an interference filter, so in the present embodiment, an interference filter whose transmission threshold wavelength is 800 nm is adopted. In this wavelength, since a contact-type linear image sensor, which is the information reading unit 11 has sufficient sensitivity, there arises no problem when the filter 10 is adopted.

Information reading unit 11 is, for example, the contact-type linear image sensor composed of a rod lens array and a CCD array. As to irradiation of a light onto the document 14 for information reading, a system of transmitting a light transmitted through the filter 10 to the both sides of the information reading unit 11 by means of the optical fiber array 12 so as to irradiate the light on the document 14 therefrom is adopted. With this arrangement, irradiation of a light to a reading position of the document 14 and incidence of its reflected light to the information reading unit 11 become easy, thereby making it possible to read image information from the document 14 satisfactorily.

An outer surface of the optical head unit 4 is covered by a body of equipment 4*a* in order to prevent a light of the cylindrical white light source 5 from leaking through a position other than the shutter arrays 6 through 8 to an outside of the optical head unit 4, namely, to prevent irradiation of unnecessary light to the photoreceptor 1.

In addition, the image forming apparatus has a controller 21 as controlling means shown in FIG. 2 for controlling an operation for reading image information from the document 14 and an operation for writing the image information to the paper 13. The controller 21 having a microcomputer in its inner section controls the cylindrical white light source 5, the exposure shutter array 6, information reading shutter array 7, the charge eliminating shutter array 8 in the optical head unit 4 a main driving section 23, a carrier driving section 24, a developing bias applying section 25, a transfer voltage applying section 26, a fixing unit 27, etc. Moreover, a memory 22 for storing image information read in the optical head unit 4 is connected to the controller 21.

The main driving section 23 is means for rotating the photoreceptor 1, the magnetic roller 2*d* of the developer unit 2, etc. The carrier driving section 24 including the transfer roller 3 and the carrying roller 15 . . . is means for carrying the paper 13 and the document 14. The developing bias applying section 25 is means for applying developing bias of dozens V across the developing sleeve 2*c* and the transparent conductive layer 1*b*. The transfer voltage applying section 26 is means for applying a voltage for transferring a toner image, which has been formed on the surface of the photoreceptor 1, onto the paper 13 to the transfer roller 3. Moreover, the fixing unit 27 is means for fixing the toner image, which has been transferred onto the paper 13, on the sheet 13.

First, an image information writing process in the image forming apparatus having the above arrangement will be explained.

When the image information writing process is set by an inputting operation of an operation panel, not shown, etc., the controller 21 makes the photoreceptor 1 rotate, makes the magnetic roller 2*d* of the developing roller 2*b* in the developer unit 2 rotate and also operates the developing bias applying section 25. When the magnetic roller 2*d* rotates, the conductive magnetic toner Ta in the developer vessel 2*a* is maintained on the surface of the developing sleeve 2*c* by the alternating magnetic field generated by the rotation, and is carried to a developing position where the surface of the photoreceptor 1 faces the surface of the developing sleeve 2*c*. In this developing position, a direction in which the surface of the photoreceptor 1 rotating in a direction of A in FIG. 1 moves is same as a direction in which the conductive magnetic toner Ta is carried.

In addition, the controller 21 turns on the cylindrical white light source 5, and opens and closes the exposure shutter array 6 based upon the image information stored in the memory 22. The light of the cylindrical white light source 5, which is transmitted through the exposure shutter array 6 according to the open/close operation, is irradiated to an area of the photoreceptor 1 where the conductive magnetic toner Ta contacts and removes. As a result, the photoreceptor 1 is exposed so that the toner image is formed on the photoreceptor 1 by the aforementioned principle. The toner image is transferred onto the paper 13 by the transfer roller 3 to which a transfer voltage has been applied so as to be fixed on the paper by the fixing unit 27.

After the fixing process, when a printing start area of the photoreceptor 1 reaches an opposite position of the charge eliminating shutter array 8, the controller 21 opens the charge eliminating shutter array 8. As a result, charges are eliminated from the photoreceptor 1 by the light of the cylindrical white light source 5 which passes through the charge eliminating shutter array 8. Moreover, conductive magnetic toner Ta which remains on the surface of the photoreceptor 1 is collected by the cleaning blade 16 provided in the developer vessel 2*a*. Here, during the image information writing process, the information reading shutter array 7 is in a closed state.

Next, the reading process in the image forming apparatus will be explained. When an image information reading mode is set, the controller 21 stops operations of the developing bias applying section 25 and the transfer voltage applying section 26, and makes the photoreceptor 1 rotate once so as to remove the conductive magnetic toner Ta which remains on the surface of the photoreceptor 1. After the completion of cleaning, the controller 21 stops the photoreceptor 1 and controls the carrier driving section 24 so as to change driving speeds of the carrying roller 15 and the transfer roller 3 to a speed which is suitable for reading the image information by means of the information reading unit 11.

Next, when the document 14 is carried by the carrying roller 15, the controller 21 opens the information reading shutter array 7. At this time, the exposure shutter array 6 and the charge eliminating shutter array 8 are in closed state. As a result, a light is irradiated on the document 14 by the cylindrical white light source 5, and its reflected light comes into the information reading unit 11 so that the document 14 is read. In other words, the reflected light, which has come into the information reading unit 11, comes into the CCD array through the rod lens array so as to be converted into an image signal. The image signal is stored in the memory 22.

In the image forming apparatus, in the image information reading process, since a light, which is hardly absorbed in the photoconductive layer 1*c*, is selected by the filter 10 so as to be irradiated on the document 14, the information can be read accurately. Moreover, in the image forming apparatus, the exposing means, the information reading means and the charge eliminating means constitute the optical head unit 4, and the cylindrical white light source 5 which is used in common for the three means is a light source for each means as well as the three means respectively have the one liquid crystal shutter array 6 through 8 for opening and closing an optical path from the cylindrical white light source 5 to the photoreceptor 1. Therefore, an apparatus can be sufficiently miniaturized in the arrangement adopting the SCED process. Moreover, the exposing means and the information reading means and the charge eliminating means use the liquid crystal shutter arrays 6 through 8 as means for opening and closing the optical path from the cylindrical white light source 5 to the photoreceptor 1, thereby making it possible to easily and accurately control the open/close operation of the optical path.

In addition, when the document 14 was read and read image information was written to the paper 13 by the apparatus in practice, an excellent image, which compares favorably with the original document, was obtained.

[EMBODIMENT 2]

Figure 3:
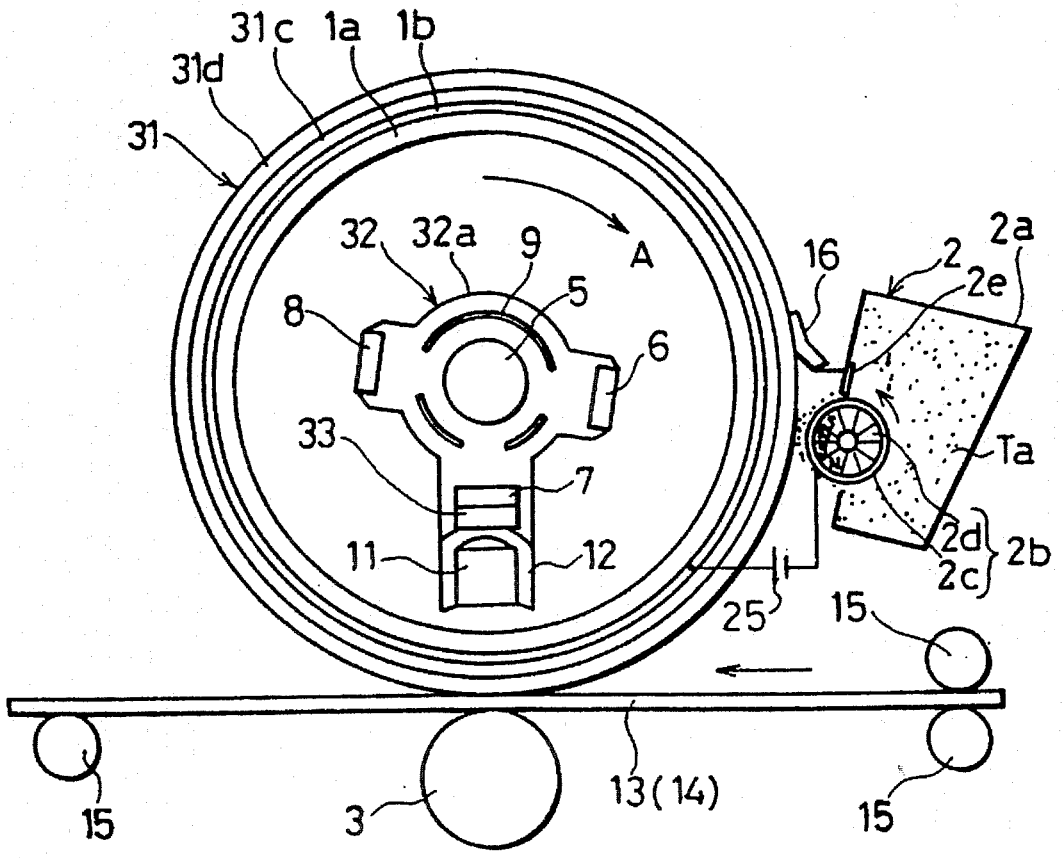

The following will discuss another embodiment of the present invention referring to FIG. 3. Here, for convenience of explanation, those members that have the same arrangement and functions, and that are described in the aforementioned embodiments are indicated by the same reference numerals and the description thereof is omitted.

An image forming apparatus of the present embodiment includes a photoreceptor 31 instead of the photoreceptor 1 shown in FIG. 1 and an optical head unit 32 having a filter 33 instead of the optical head unit 4 having the filter 10. Here, 32*a* is a body of equipment having the same arrangement as that of the body of equipment 4*a*. The other arrangements are same as that shown in FIG. 1.

The photoreceptor 31 is arranged such that a transparent conductive film 1*b*, a charge generating layer 31*c* of about 0.3 μm and a charge transport layer 31*d* of about 3 μm are formed on a transparent carrier 1*a* in this order. The transparent conductive film 1*b* is arranged such that an ITO film of 500 A and a $SnO_2$ film of 500 A are formed, the charge generation layer 31*c* is composed of fluorenone disazo pigment as a charge generating material, and the charge transport layer 31*d* is composed of α-phenyl stilbene compound as a charge transport material. Spectral sensitivity of the photoreceptor 31 is substantially constant in wavelength from 500 to 650 nm, and reduces above wavelength of 650 nm. Therefore, as the filter 33, an interference filter with center wavelength of 750 nm and a sharp cut filter (transmission threshold wavelength: 480 nm) are used.

When a document 14 was read and read image information was written to paper 13 by the apparatus in practice, an excellent image, which compares favorably with an original document, was obtained.

Here, as to the arrangements of embodiments 1 and 2, an example where the a-Si:H photoreceptor 1 and the organic photoreceptor 31 are used is described, but the image forming apparatus of the present invention is not limited to an apparatus adopting these photoreceptors. In other words, even in the case where a photoreceptor where another organic materials are used, and a Se photoreceptor are used, the filter 33 for transmitting only a light, which is not absorbed in an photoconductive layer of the photoreceptor, may be selected.

[EMBODIMENT 3]

Figure 4:
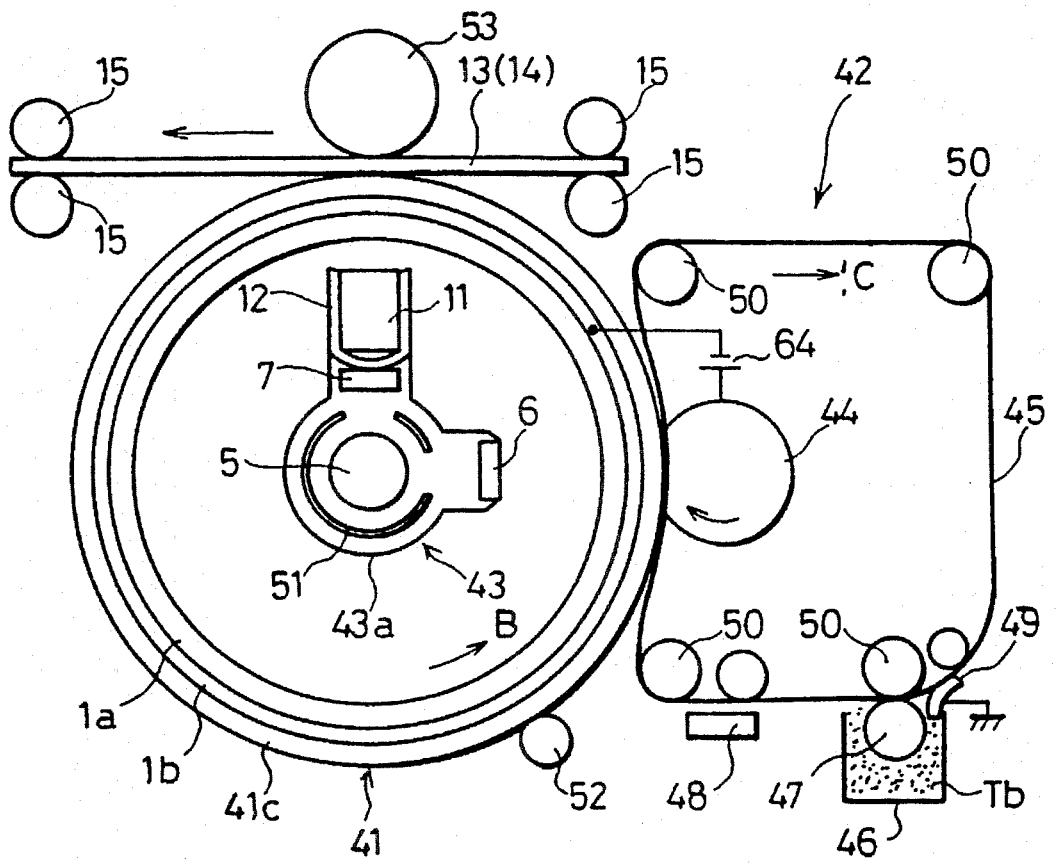
Figure 5:
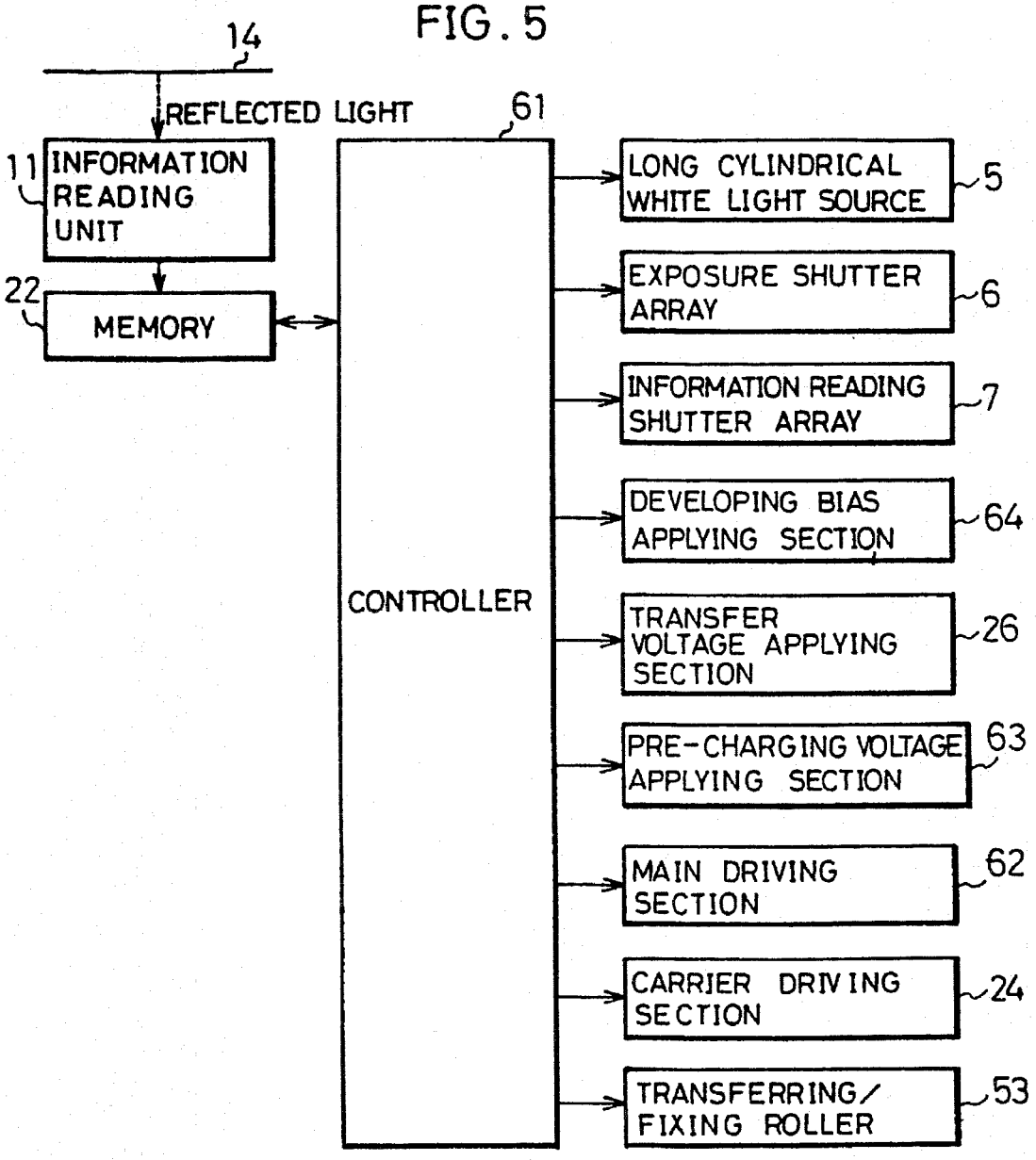

The following will discuss another embodiment of the present invention referring to FIGS. 4 and 5. Here, for convenience of explanation, those members that have the same arrangement and functions, and that are described in the aforementioned embodiments are indicated by the same reference numerals and the description thereof is omitted.

An image forming apparatus of the present embodiment, has an image carrier 41 having an insulating layer 41*c* on its surface instead of the photoreceptor 1 shown in FIG. 1, and uses photoconductive toner Tb instead of the conductive magnetic toner Ta. As shown in FIG. 4, the image forming apparatus includes the cylindrical image carrier 41, a developer unit 42 and a cleaning unit 52 which are positioned on a side on a peripheral surface of the image carrier 41, transfer and fixing roller 53 which is positioned on an upper side and an optical head unit 43 which is positioned inside the image carrier 41.

The image carrier 41 is arranged such that a transparent conductive film 1*b* and the insulating layer 41*c* are formed on a transparent carrier 1*a* in this order. An a-SiO:H film with a thickness of 3 μm is used as the insulating layer 41*c*. Besides the a-SiO:H film, an a-SiN:H film, an a-SiC:H film or an insulating carbon (i-C:H) film, etc. can be used.

The developer unit 42 includes an electrode 44 which is positioned oppositely to the image carrier 41 across a dielectric belt 45, the endless dielectric belt 45, a developer vessel 46, a feeding roller 47 provided in the developer vessel 46, a pre-charger 48, a conductive cleaning unit 49, and four driving rollers 50 . . . which moves the dielectric belt 45 in direction of arrow C.

The electrode 44 composed of an conductive elastic roller with electrical contacts with a rear surface of the dielectric belt 45, and is pressed against the image carrier 41 by constant pressure through the dielectric belt 45 so that a distance between the electrode 44 and the image carrier 41 is kept constant. Therefore, a wide nip width is secured between the electrode 44 and the image carrier 41. Moreover, a conductive brush or an electrode formed so as to have a same shape as the image carrier 41, etc. can be also used as the electrode 44.

The dielectric belt 45 is composed of polyethylene terephthalate (PET). As a material of the dielectric belt 45, polypropylene or polyester, etc. can be used besides the PET. Here, an Al thin film is evaporated on the rear surface of the dielectric belt 45 as an electrode. A corona charger having a sawtooth type electrode is used as the pre-charger 48 in order to decrease generation of ozone. As the pre-charger 48, a solid state discharge element, or a stylus discharge device, etc. can be used besides the corona charger. The cleaning unit 49 is composed of a cleaning blade with conductivity which has been formed by dispersing carbon black in urethane rubber. The cleaning unit 49 is grounded so as to remove residual toner Tb from the surface of the dielectric belt 45 as well as eliminate charges from the dielectric belt 45. As a material of the cleaning unit 49, also nylon in which carbon black is dispersed, or ETFE, etc. can be used.

The photoconductive toner Tb is made up of a photosensitive agent such as phthalocyanine, zinc oxide (in some cases, a sensitizing agent is added), coolant, resin, etc. Cyan, magenta, yellow and black photoconductive toner Tb for forming a color image can be produced by selecting photosensitive agent and colorant. As to a developing process using the photoconductive toner Tb, a wet process in which the photoconductive toner Tb is dispersed in an insulating liquid and a conventional dry process are known. The apparatus of the present embodiment adopts the wet process using photoconductive toner Tb for monochrome.

The optical head unit 43 includes a cylindrical white light source 5, an exposure shutter array 6, an information reading shutter array 7, a light blocking member 51, an information reading unit 11 and an optical fiber array 12. The exposure shutter array 6 is provided opposite to the electrode 44, and the information reading shutter array 7 is provided opposite to a transfer and fixing roller 53. The light blocking member 51 covers around the cylindrical white light source 5 so that a light of the cylindrical white light source 5 is irradiated only to the shutter arrays 6 and 7. The outer surface of the optical head unit 43 is covered by a body of equipment 43*a* having the same function as the body of equipment 4*a*.

The cleaning unit 52 composed of a sponge roller, for example, removes residual toner from the surface of the image carrier 41 and collects it. The transfer and fixing roller 53 transfers a toner image from the image carrier 41 onto paper 13 and fixes the toner image thereon. Therefore, the transfer and fixing roller 53 contains a heating element. Since the transfer and fixing roller 53 is provided in an upper position of the image carrier 41, in the image forming apparatus of the present embodiment, the paper 13 for writing an image and the document 14 for reading an image are carried in the upper position of the image carrier 41. With this arrangement, dirt on paper due to falling photoconductive toner Tb can be prevented.

In addition, since the image carrier 41 with light transmitting characteristics is used instead of the photoreceptor 1 in the image forming apparatus of the present embodiment, the optical head unit 43 does not require a filter 10 shown in FIG. 1, namely, information can be read by a white light.

In addition, the image forming apparatus includes a controller 61 shown in FIG. 5 as controlling means instead of the controller 21 shown in FIG. 1. The controller 61 controls the cylindrical white light source 5, the exposure shutter array 6, the information reading shutter array 7 of the optical head unit 43, a main driving section 62 instead of the main driving section 23, a carrier driving section 24, a developing bias applying section 64 instead of the aforementioned developing bias applying section 25, a transfer voltage applying section 26, a pre-charging voltage applying section 63 and the transfer and fixing roller 53, etc.

The developing bias applying section 64 is means for applying a voltage across the electrode 44 and the transparent conductive film 1*b* of the image carrier 41 so as to generate an electric field in which the electrode 44 has a positive polarity. The pre-charging voltage applying section 63 is means for applying a charging voltage to the pre-charger 48.

With the above arrangement, first, a process for writing image information in the image forming apparatus will be explained. Here, in the conventional electrophotographic process, electrostatic force which acts on toner is modulated by a light so that an image is formed. On the contrary, in the present process using the photoconductive toner Tb, charges of toner is changed by a light so that an image is formed.

When an image information writing process is set, the controller 61 makes the image carrier 41 rotate and operates the developer unit 42. A thin coating layer of the photoconductive toner Tb, which has been agitated in the developer vessel 46 in the developer unit 42, is supplied to the surface of the dielectric belt 45 by the feeding roller 47. A layer thickness in this case is 20 to 40 μm. The photoconductive toner Tb on the dielectric belt 45 is negatively charged by the pre-charger 48 uniformly. The photoconductive toner Tb is carried to between the insulating layer 41*c* of the image carrier 41 and the electrode 44.

At this time, the controller 61 operates the developing bias applying section 64. As a result, an electric field, which makes polarity of the electrode side 44 positive, is generated. Moreover, the controller 61 turns on the cylindrical white light source 5, and opens and closes the exposure shutter array 6 based upon image information stored in a memory 22. A light of the cylindrical white light source 5 which is transmitted through the exposure shutter array 6 is irradiated to the photoconductive toner Tb according to the open/close operation of the exposure shutter array 6. In an area where the light has been irradiated, polarity of the photoconductive toner Tb is reversed by injection of charges due to light absorption. Therefore, the photoconductive toner Tb moves from the dielectric belt 45 to the transparent conductive film 1*b* so that a negative image is obtained on the surface of the image carrier 41. The toner image is carried to the transfer and fixing roller 53 by the rotation of the image carrier 41 so as to be transferred and fixed on the sheet 13 by the transfer and fixing roller 53.

After the above transfer and fixing process, residual toner Tb is removed from the the surface of the image carrier 41 and collected by the cleaning unit 52. Meanwhile, residual toner Tb on the surface of dielectric belt 45 is removed by the cleaning unit 49. Moreover, at this time, charges are eliminated from the dielectric belt 45 by the cleaning unit 49. Here, in the above image information writing process, the information reading shutter array 7 is in a closed state.

Next, a reading process in the image forming apparatus will be explained. When an image information reading mode is set, the controller 61 stops operations of the developing bias applying section 64, the transfer voltage applying section 26 and the pre-charging voltage applying section 63. Then, the controller 61 makes the image carrier 41 rotate once so as to remove the photoconductive toner Tb which remains on the surface of the image carrier 41. After completion of the cleaning, the controller 61 stops the image carrier 41 and controls the carrier driving section 24 so as to change a driving speed of the carrying roller 15 and the transfer and fixing roller 53 to a speed suitable for reading image information by the information reading unit 11.

Next, when the document 14 is carried by the carrying roller 15, the controller 61 opens the information reading shutter array 7. At this time, the exposure shutter array 6 is in a closed state. As a result, a light is irradiated on the document 14 by the cylindrical white light source 5, and its reflected light comes into the information reading unit 11 so that an image of the document is read. This image information is stored in the memory 22.

In the image forming apparatus of the present embodiment, since the one cylindrical white light source is shared by the exposing means and the information reading means which constitute the optical head unit 43 as a light source and the two means have the shutter arrays 6 and 7 for opening and closing the optical path of the cylindrical white light source 5 towards the image carrier 41 respectively, in an arrangement which adopts the SCED process, an apparatus can be sufficiently miniaturized. Moreover, it is the same point as the aforementioned case that the exposing means and the information reading means uses the liquid crystal shutter arrays 6 and 7 respectively, thereby making it possible to easily and securely control the open/close operation of the optical path.

In addition, when the document 14 was read and read image information was written to paper 13 by the apparatus in practice, an excellent image, which compares favorably with an original document, was obtained.

[EMBODIMENT 4]

Figure 6:
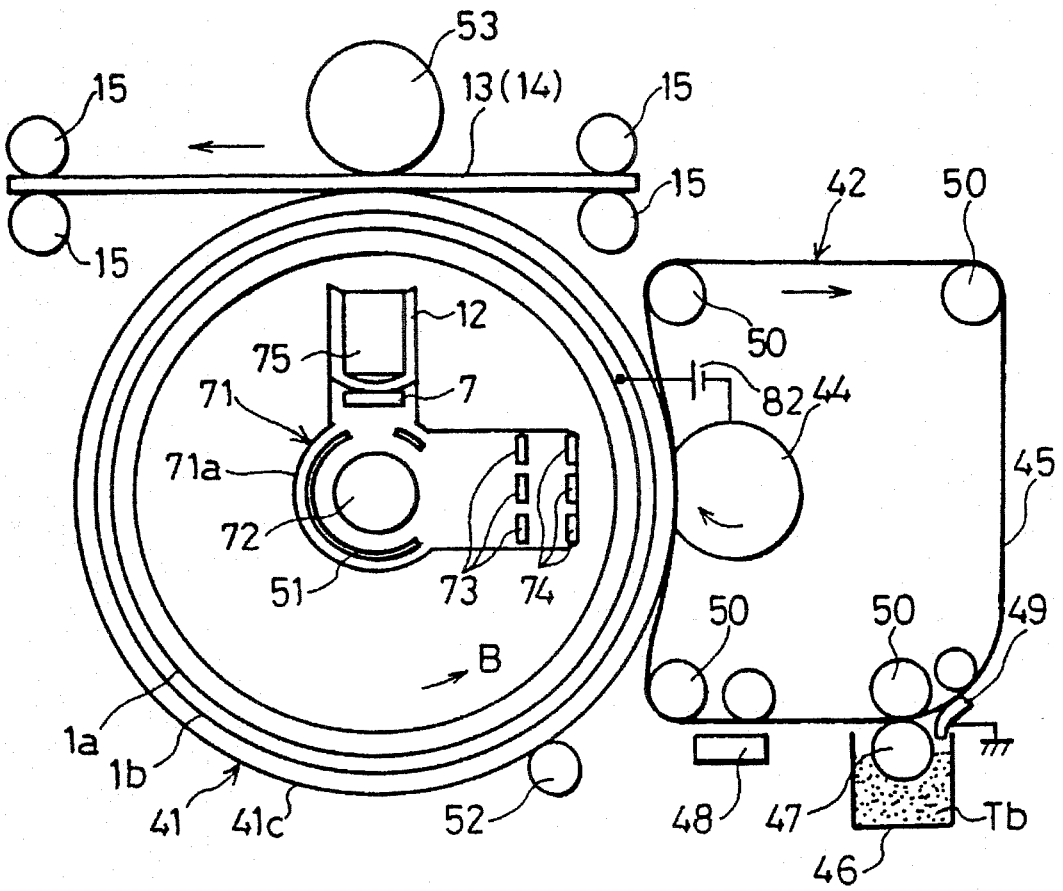
Figure 7:
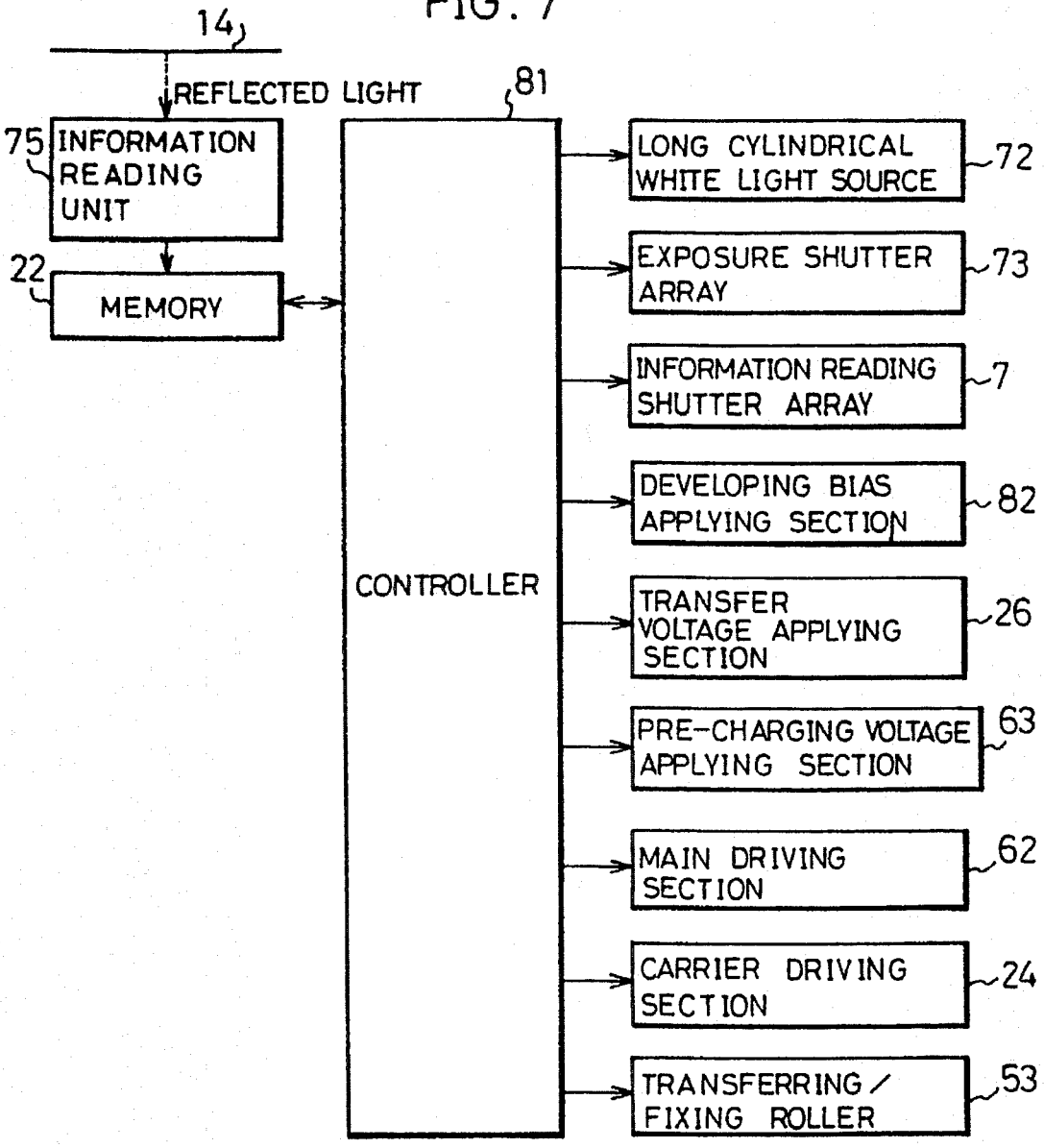

The following will discuss still another embodiment of the present invention referring to FIGS. 6 and 7. Here, for convenience of explanation, those members that have the same arrangement and functions, and that are described in the aforementioned embodiments are indicated by the same reference numerals and the description thereof is omitted.

An image forming apparatus of the present embodiment is a color image forming apparatus which is capable of forming a full-color image. Therefore, in the image forming apparatus, color photoconductive toner Tb for cyan, magenta and yellow is used and a wet developing process is adopted.

As shown in FIG. 6, the image forming apparatus of the present embodiment includes a cylindrical image carrier 41, a developing unit 42 and a cleaning unit 52 provided beside a peripheral surface of the image carrier 41, a transfer and fixing roller 53 provided above the peripheral surface of the image carrier 41, and an optical head unit 71 provided inside the image carrier 41. A developer vessel 46 of the developer unit 42 contains cyan, magenta and yellow photoconductive toner Tb with the photoconductive toner for each color mixed up.

The optical head unit 71 includes a cylindrical white light source 72, three-exposure-shutter array 73 . . . , color filters 74 . . . for 3 colors (R, G, B), an information reading shutter array 7, a light blocking member 51, an information reading unit 75 and an optical fiber array 12. In the present embodiment, a fluorescent lamp is used as the cylindrical white light source 72. Here, reason for using the fluorescent lamp instead of a halogen lamp is because of simplifying of an arrangement. In other words, since color balance of the halogen lamp is inclined towards infrared region and a CCD color sensor provided in the information reading unit 75 has sensitivity to a long wavelength region, so that the compensation by a filter is required. Therefore, likewise the arrangement shown in FIG. 1, when an infrared cut filter is provided in the information reading shutter array 7, the halogen lamp can be also used.

The three-exposure-shutter array 73 . . . are positioned oppositely to an electrode 44 respectively. The color filters 74 . . . for three colors RGB are positioned on an electrode 44 side of the exposure shutter array 73 so that color filters 74 are opposed to the respective exposure shutter array 73. The information reading unit 75 includes the CCD color sensor (not shown). An outer surface of the optical head unit 71 is covered by a body of equipment 71*a* having the same function as the aforementioned body of equipment 4*a*.

In addition, the image forming apparatus of the present embodiment includes a controller 81 shown in FIG. 7 as controlling means instead of the controller 61 shown in FIG. 5. The controller 81 controls the cylindrical white source light 72, the exposure shutter array 73 . . . , the information reading shutter array 7, a main driving section 62, a carrier driving section 24, a developing bias applying section 82 instead of the developing bias applying section 64 shown in FIG. 5, a transfer voltage applying section 26, a pre-charging voltage applying section 63, etc. in the optical head unit 71. The developing bias applying section 82 is means for applying a voltage across the electrode 44 and a transparent conductive film 1*b* of the image carrier 41 so as to generate an electric field in which the transparent conductive film 1*b* side has positive polarity.

In an image information writing process in the image forming apparatus of the present embodiment, the photoconductive toner Tb for cyan, magenta and yellow in the developer vessel 46 is carried to between an insulating layer 41*c* of the image carrier 41 and the electrode 44 by a dielectric belt 45. Here, when the controller 81 operates the developing bias applying section 82, an electric field in which the transparent conductive film 1*b* side has positive polarity is generated, and the photoconductive toner Tb on the dielectric belt 45 is attracted to the transparent conductive film 1*b* side.

Next, when the controller 81 turns on the cylindrical white light source 72 and opens and closes the exposure shutter array 6 so as to expose an image. For example, when an image is exposed by a blue light, the yellow photoconductive toner Tb absorbs the light and its polarity is reversed. Then, the yellow photoconductive toner Tb moves to the electrode 44 side, namely, the dielectric belt 45 side. As a result, the image carrier 41 side is changed from black to blue, and the dielectric belt 45 side is changed from white to yellow. Also in the case where an image is exposed by a green or red light, each photoconductive toner Tb responds in the same manner as the above so that a positive image is formed on the image carrier 41 side and a negative image is formed on the dielectric belt 45 side. Here, during the image information writing process, the information reading shutter array 7 is in a closed state.

In the image forming apparatus of the present embodiment, as mentioned above, each image information for each color is delayed according to its writing process speed so as to be inputted to the exposure shutter array 73 and is exposed, thereby making it possible to obtain a color image. Here, a reading process is same as that explained in the embodiment 3. Moreover, the exposing means and information reading means which constitute the optical head unit 71 share the one cylindrical white light source 72 and both the means have the liquid crystal shutter arrays 73 and 7 for opening and closing the optical path, thereby making it possible to sufficiently miniaturize an apparatus and to easily and securely open and close the optical path toward the image carrier 41 by the cylindrical white light source 72. These are the points which are same as the image forming apparatus in the embodiment 3.

In addition, when the document 14 was read and read image information was written to paper 13 by the apparatus in practice, an excellent image, which compares favorably with an original document, was obtained.

[EMBODIMENT 5]

Figure 8:
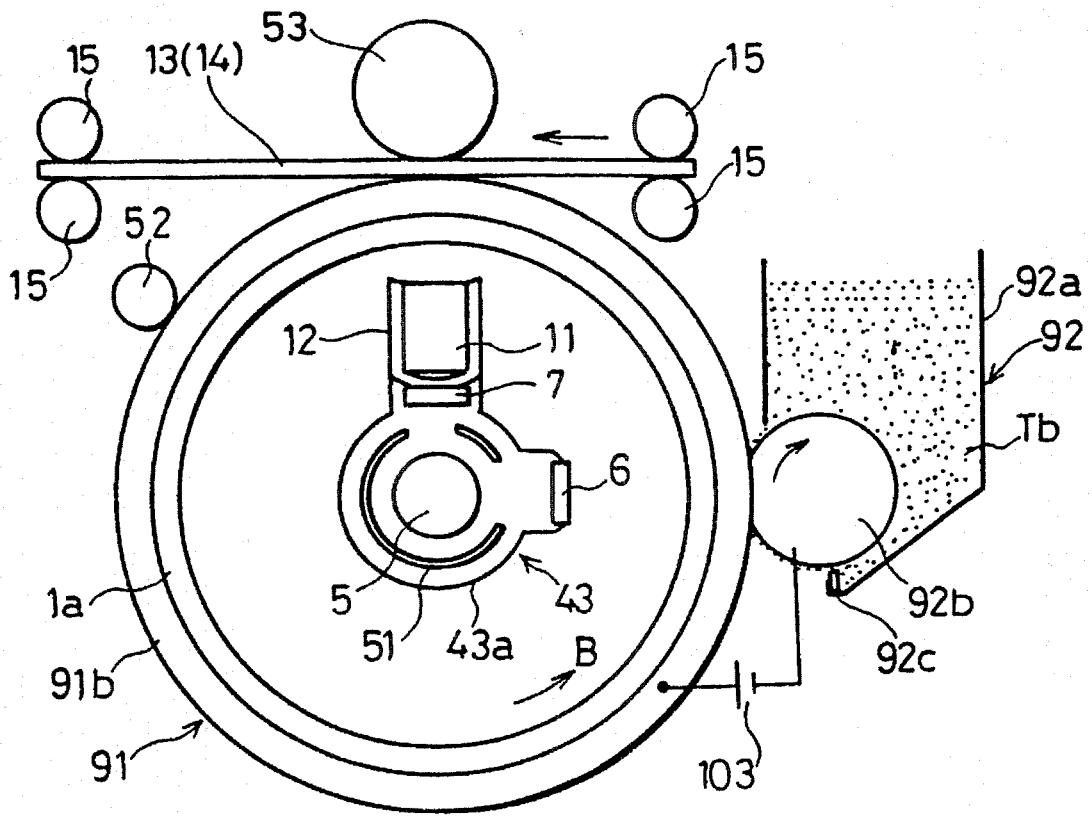
Figure 9:
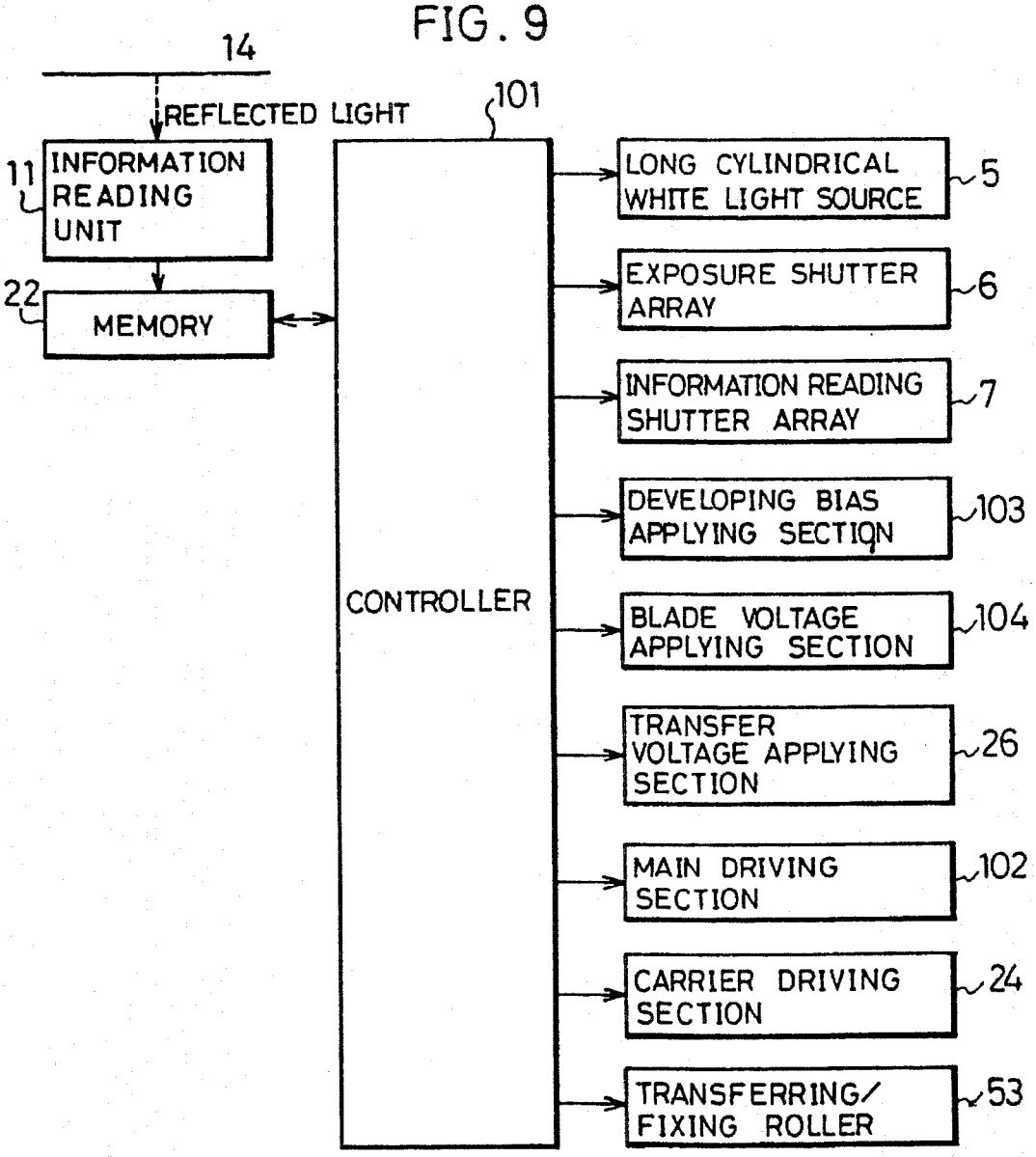

The following will discuss still another embodiment of the present invention referring to FIGS. 8 and 9. Here, for convenience of explanation, those members that have the same arrangement and functions, and that are described in the aforementioned embodiments are indicated by the same reference numerals and the description thereof is omitted.

In an image forming apparatus of the present embodiment, photoconductive toner Tb is used and the dry developing process is adopted. As shown in FIG. 8, the image forming apparatus includes a cylindrical image carrier 91, a developer unit 92 and a cleaning unit 52 provided beside a peripheral surface of the image carrier 91, a transfer and fixing roller 53 provided above the peripheral surface of the image carrier 91, and an optical head unit 43 provided inside the image carrier 91.

The image carrier 91 is arranged so that a transparent conductive film 91*b* is formed on a surface of a transparent carrier 1*a*. As the transparent conductive film 91*b*, a film in which an ITO film of 1000 A and a $SnO_2$ film of 1000 A are formed is used.

The developer unit 92 contains the photoconductive toner Tb in the developer vessel 92*a*, and feeds the photoconductive toner Tb to the image carrier 91 by means of a feeding roller 92*b* with elasticity and conductivity. A thickness of the toner layer on the feeding roller 92*b* is controlled by a blade 92*c* with conductivity. It is possible to use two-components toner, magnetic single-component toner, or non-magnetic single-component toner as the photoconductive toner Tb, but in order to form a thin layer with 2 to 3 layers of toner particles on a surface of the feeding roller 92*b*, the non-magnetic single-component toner is favorable.

In addition, the image forming apparatus of the present embodiment includes a controller 101 shown in FIG. 9 as control means. The controller 101 controls the cylindrical white light source 5, an exposure shutter array 6, an information reading shutter array 7 in the optical head unit 43, a main driving section 102 instead of the main driving section 23, a carrier driving section 24, a developing bias applying section 103, a blade voltage applying section 104, transfer and fixing roller 53, etc. The developing bias applying section 103 is means for applying a voltage across feeding roller 92*b* and the transparent conductive film 91*b* so that the feeding roller 92*b* has negative polarity. The blade voltage applying section 104 is means for applying a negative low voltage to a blade 92*c*.

In an image information writing process of the image forming apparatus of the present embodiment, when the photoconductive toner Tb is negatively charged by the blade 92*c* and adheres to a surface of the feeding roller 92*b* such that a thin layer is formed, the photoconductive layer Tb is carried to a contact area with the image carrier 91 which rotates in direction B.

Here, when the controller 101 turns on the cylindrical white light source 5 and opens and closes the exposure shutter array 6, a toner image is formed on the surface of the image carrier 91 according to the above mentioned principle. The toner image is transferred to and fixed on paper 13 by the transfer and fixing roller 53. Moreover, residual toner Tb is removed from the surface of the image carrier 91 and is collected by the cleaning unit 52. Here, during the image information writing process, the information reading shutter array 7 is in closed state.

Meanwhile, in an image information reading process, the controller 101 stops operations of the developing bias applying section 103, the blade voltage applying section 104 and the transfer voltage applying section 26. The subsequent operations are same as those explained in the embodiment 3. Moreover, since the optical head unit 43 is provided, it is possible to sufficiently miniaturize an apparatus and to easily and securely control open/close operation of an optical path towards the image carrier 91 by means of the cylindrical white light source 5. These are points which are same as the image forming apparatus of the embodiment 3.

In addition, when the document 14 was read and read image information was written to the paper 13 by the apparatus in practice, an excellent image, which compares favorably with an original document, was obtained.

[EMBODIMENT 6]

Figure 10:
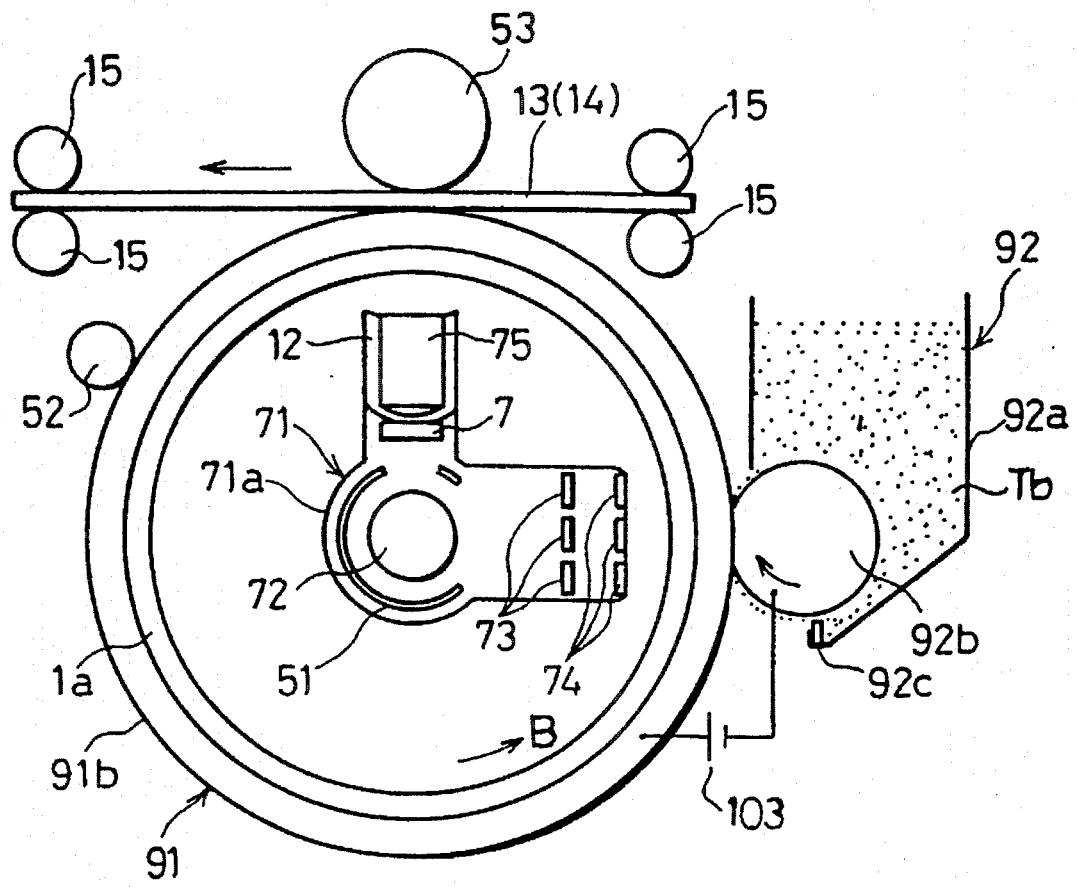
Figure 11:
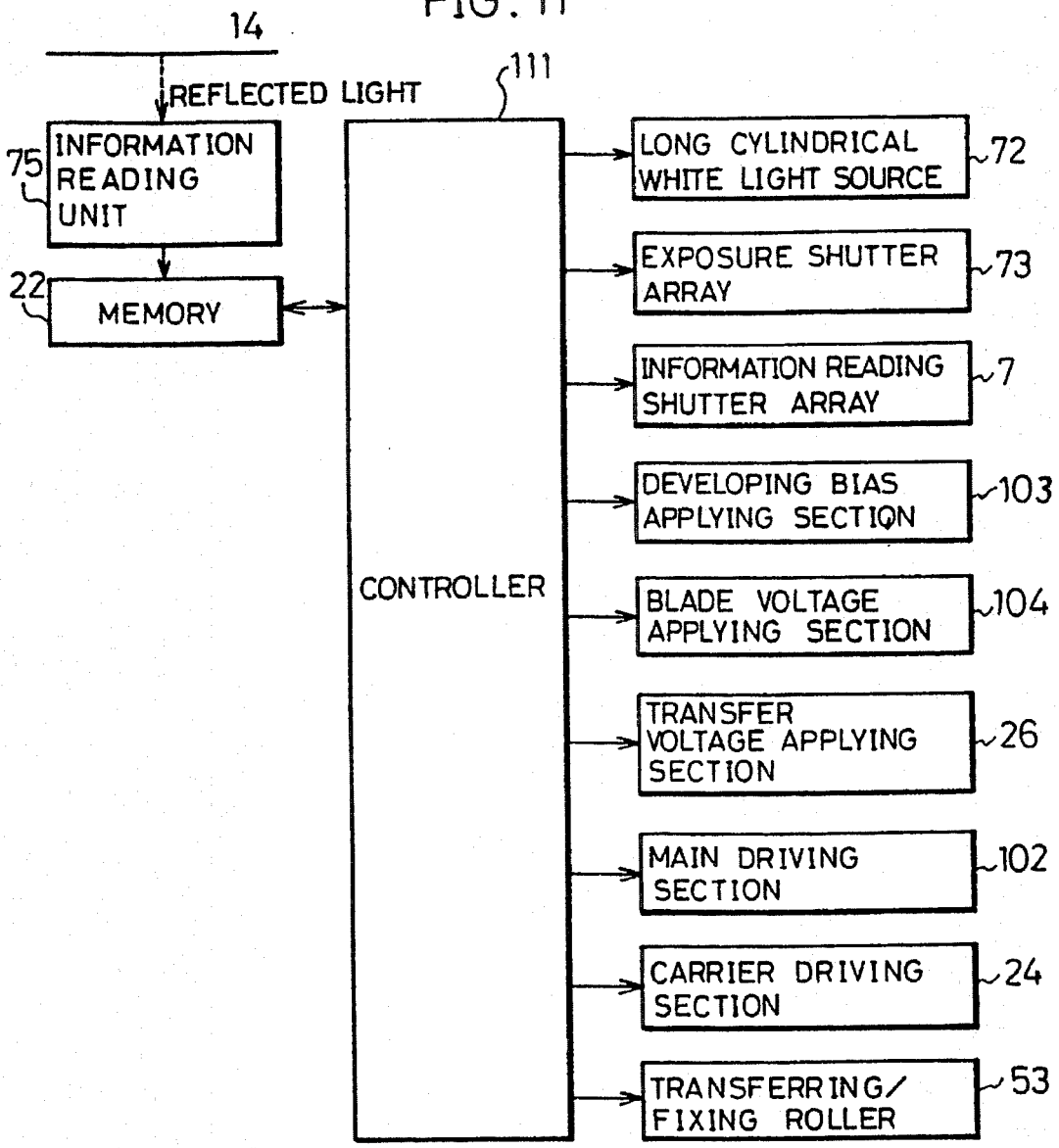

The following will discuss still another embodiment of the present invention referring to FIGS. 10 and 11. Here, for convenience of explanation, those members that have the same arrangement and functions, and that are described in the aforementioned embodiments are indicated by the same reference numerals and the description thereof is omitted.

An image forming apparatus of the present embodiment has the same arrangement as the image forming apparatus in the embodiment 5 and is capable of forming a color image. Therefore, in the image forming apparatus, color photoconductive toner Tb for cyan, magenta and yellow is used and the dry developing process is adopted. As shown in FIG. 10, the image forming apparatus includes a image carrier 91, a developer unit 92, a cleaning unit 52, a transfer and fixing roller 53 and an optical head unit 71.

In addition, the image forming apparatus includes a controller 111 as control means shown in FIG. 11. The controller 111 controls a cylindrical white light source 72, an exposure shutter array 73, an information reading shutter array 7 in the optical head unit 71, a main driving section 102, a carrier driving section 24, a developing bias applying section 103, a blade voltage applying section 104, the transfer and fixing roller 53, etc.

Functions of the respective above means are same as those mentioned above, and an image information writing process and an image information reading process of the image forming apparatus of the present embodiment are same as those in the embodiments 4 and 5. Moreover, provision of the optical head unit 71 makes it possible to sufficiently miniaturize an apparatus and to easily and securely control open/close operation of an optical path towards the image carrier 91 of the cylindrical white light source 72. These are points which are same as the image forming apparatus in the embodiment 3.

When the document 14 was read and read image information was written to paper 13 by the apparatus in practice, an excellent image, which compares favorably with an original document, was obtained.

Here, in each aforementioned embodiments, the photoreceptors 1 and 31 and the image carriers 41 and 91 has a drum-like shape, but they are not limited to this, so they may have a belt-like shape, for example.

[EMBODIMENT 7]

The following will discuss still another embodiment of the present invention referring to FIGS. 12 through 20. Here, for convenience of explanation, those members that have the same arrangement and functions, and that are described in the aforementioned embodiments are indicated by the same reference numerals and the description thereof is omitted.

Figure 12:
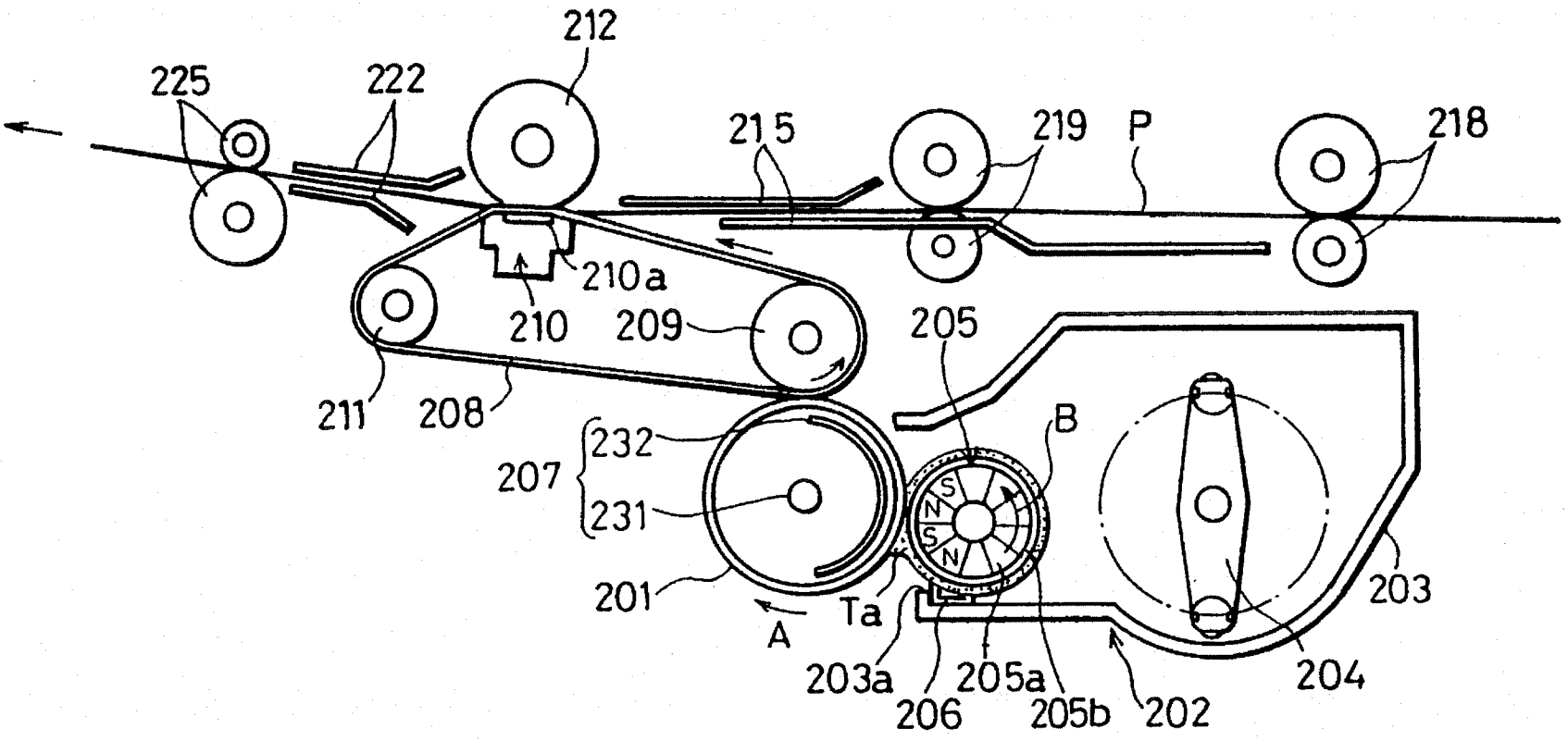

In the present embodiment, the image forming apparatus of the present invention is applied to a digital copying apparatus or printer. As shown in FIG. 12, the image forming apparatus has a photoreceptor 201 which is a cylindrical image carrier rotatable in direction A in the apparatus, a developer unit 202 on a right side of the photoreceptor 201, an exposing unit 207 inside the photoreceptor 201, and a dielectric belt 208 above the photoreceptor 201.

Figure 14:
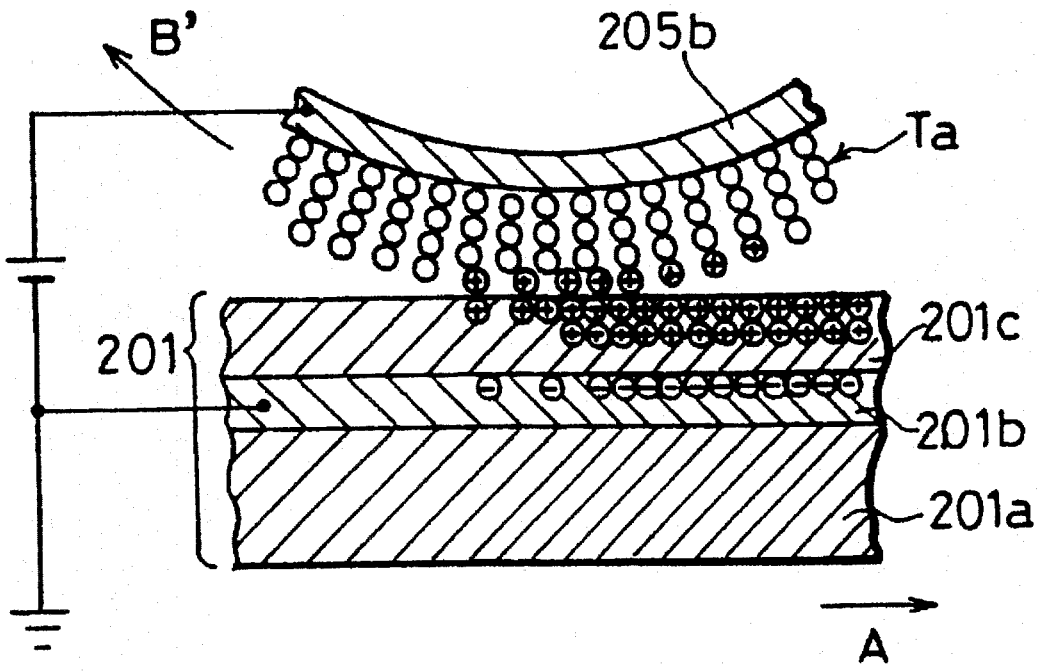

As shown in FIG. 14, the above-mentioned photoreceptor 201 is arranged such that a transparent conductive layer **201*b* made up of a sputter film such as $In_2O_3$, $SnO_2$ and a photoconductive layer 201*c* made up of photoconductive material such as Se, ZnO, CdS, amorphous Si (a-Si) are formed in this order on a surface of the a cylindrical transparent carrier 201*a* which is optically clear. Here, in the present embodiment, an $In_2O_3$ layer with thickness of 0.5 μm is formed as the transparent conductive layer 201*b*, and an a-Si layer with thickness of 3 μm is formed as the photoconductive layer 201*c***.

The developer unit 202 is composed of a developer vessel 203 for storing conductive magnetic toner Ta as a developer, an agitating roller 204 for agitating the conductive magnetic toner Ta which is rotatable in the developer vessel 203, a developing roller 205 provided at an opening **203*a* of the developer vessel 203 oppositely to the photoreceptor 201, and a doctor blade 206 which is secured below the developing roller 205 at the opening 203*a* of the developer vessel 203. The developing roller 205 retains the conductive magnetic toner Ta on a surface of a developer sleeve 205*b* by means of rotation of a magnetic roller 205*a*** in direction B and carries the conductive magnetic toner Ta in direction B' which is opposite to the direction B.

The dielectric belt 208 has excellent mechanical strength and is formed by using high temperature resistant film material mainly made up of polyimide resin so as to have an endless belt shape. The dielectric belt 208 is installed across a transfer roller 209, a heater 210, mentioned later, and a tension roller 211 so as to surround the three 209, 210 and 211. The transfer roller 209 is provided above the photoreceptor 201, the heater 210 is provided in an upper left side of the transfer roller 209 in the drawing, and the tension roller 211 is provided in a lower left side of the heater 210. Moreover, the dielectric belt 208 is caught between the photoreceptor 201 and the transfer roller 209.

Here, as to the dielectric belt 208, a film-like polyimide resin is used as its material, but the dielectric belt 208 is not particularly limited to this material, as mentioned later, so a material in which a surface where the conductive magnetic toner Ta is transferred has insulation at least may be used as mentioned later. For example, a material in which fluorine coating is applied to a metallic belt such as an electric cast nickel belt as a base material may be also used. Furthermore, as to the dielectric belt 208, its thickness is not particularly limited, but thickness of 10 μm to 200 μm is preferable to allow its heat conductivity and mechanical strength. The surface may be roughened so that gloss of an image becomes suitable.

As mentioned later, the heater 210 heats and fuses the conductive magnetic toner Ta to be transferred to the surface of the dielectric belt 208. The heater 210 is composed of a ceramic heater in which a plane Mo group heat generating resistor **210*a* is printed on an alumina ceramics substrate and glass coat is printed thereon. Moreover, the heater 210 is arranged so that its temperature is quickly raised to a prescribed heating temperature by energizing of the heat generating resistor 210***a* and that the heated surface directly contacts with the surface of the dielectric belt 208.

A pressurizing roller 212, which rotates by means of the dielectric belt 208 while pressing force towards the heater 210 is acting, is provided above the heater 210. The pressurizing roller 212 catches paper P as a recording material to be carried by a recording material carrying means 214, mentioned later, at a contact portion with the dielectric belt 208.

Figure 13:
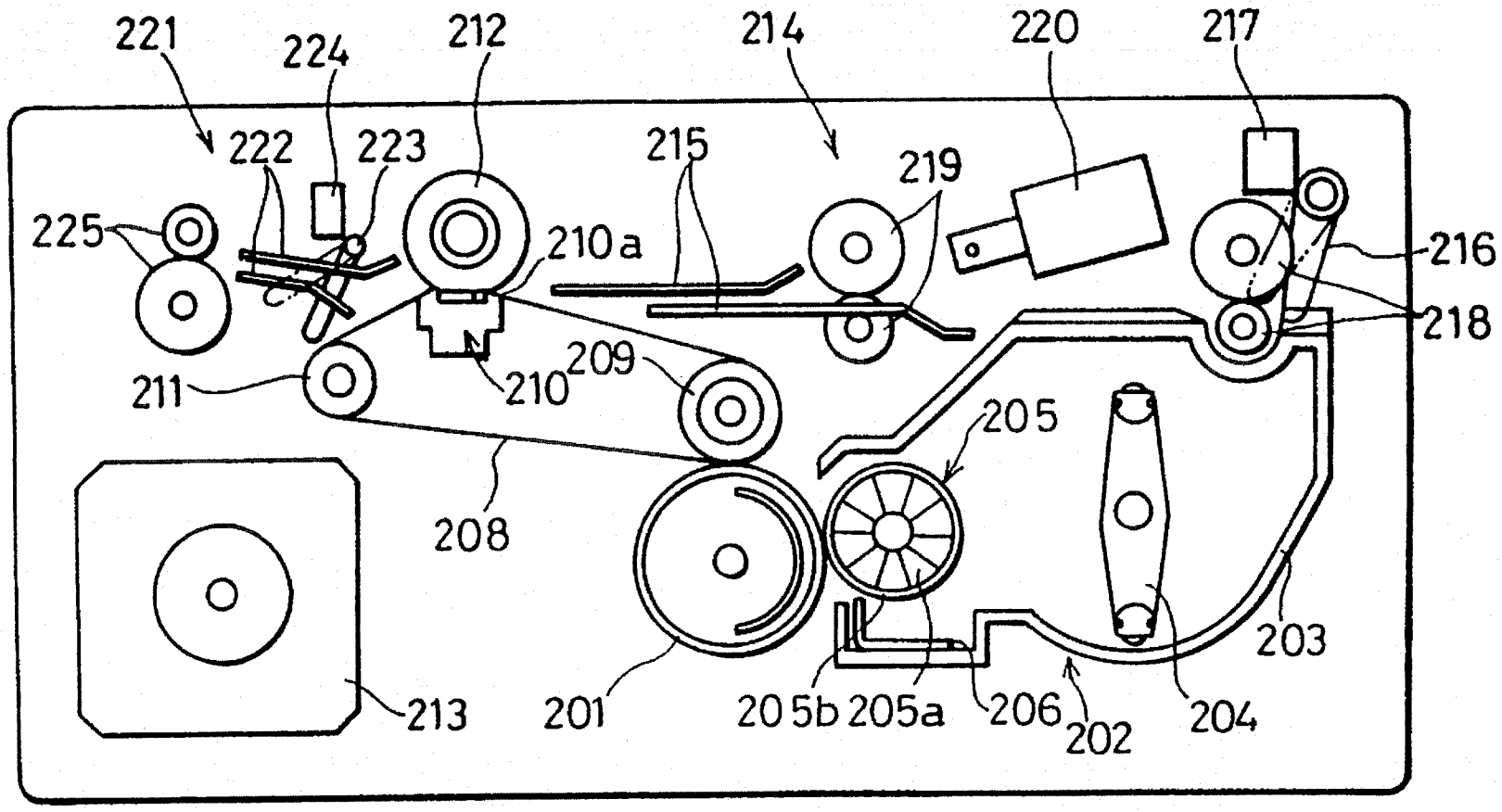

In addition, as shown in FIG. 13, the image forming apparatus of the present embodiment is provided with a stepping motor 213 which is a driving source of the apparatus, the recording material carrying means 214 for feeding the paper P to the contact portion of the dielectric belt 208 and the pressurizing roller 212, and a discharge means 221 for discharging the paper P from the apparatus.

The recording material carrying means 214, which is positioned above the photoreceptor 201, the developer unit 202 and the dielectric belt 208, includes a carrier guide plate 215, a paper insertion detecting actuator 216 positioned in the proximity of the paper feeding opening, a paper insertion detecting switch 217, a feeding roller 218, a register roller 219 positioned between the edges of the transfer guide plate 215 and a register solenoid 220 for controlling rotation of the register roller 219. The carrier guide plate 215 is a transport path which connects from a paper feeding opening, not shown, to the press-contact portion of the dielectric belt 208 and the pressurizing roller 212.

The discharge means 221 is positioned on a left side of the press-contact portion of the dielectric belt 208 and the pressurizing roller 212. The paper discharge means 221 is composed of a discharge guide plate 222, a discharge detecting actuator 223, a paper discharge detecting switch 224, and discharge roller 225. The discharge guide plate 222 is a discharge path which connects from the press-contact portion of the dielectric belt 208 and the pressurizing roller 212 to a discharge opening, not shown. The paper discharge actuator 223 and the paper discharge detecting switch 224 are positioned in the proximity of the press-contact portion of the dielectric belt 208 and the pressurizing roller 212. The paper discharge roller 225 is positioned on the end side of the discharge guide plate 222.

Figure 15:
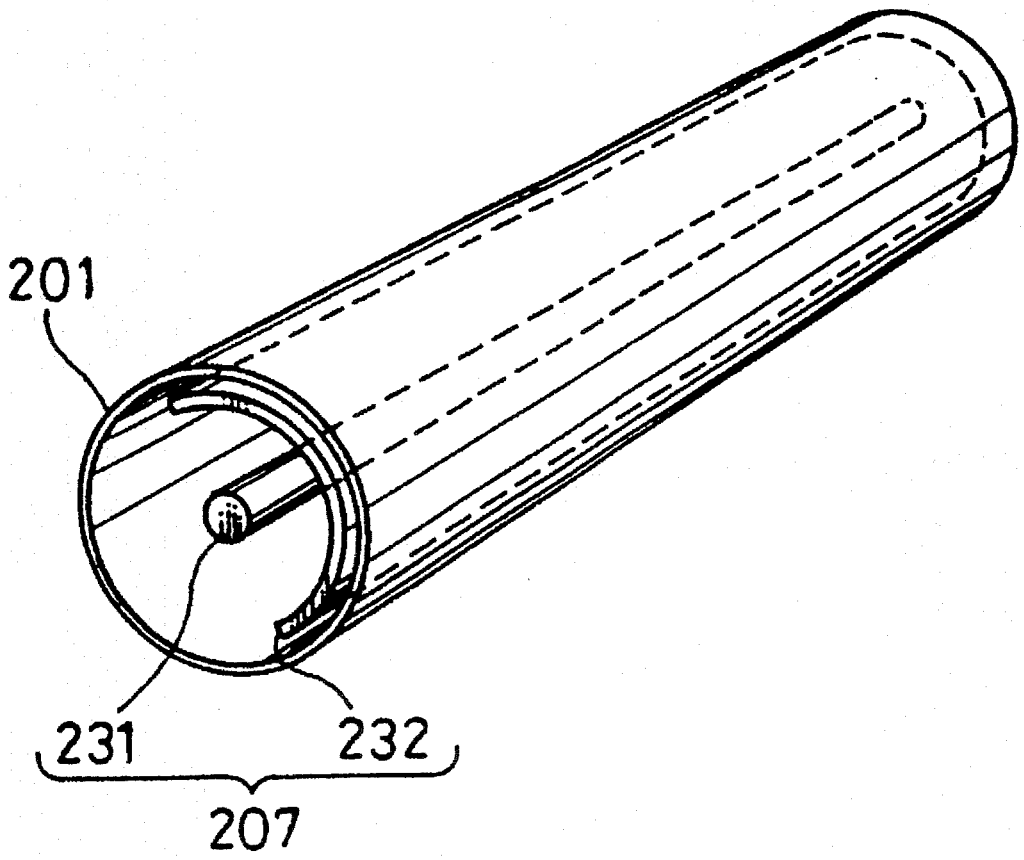

Also as shown in FIG. 15, the exposing unit 207 includes a fluorescent lamp 231 as a cylindrical light source and a two-dimensional liquid crystal shutter array 232. The fluorescent lamp 231 is provided in the axis position of the photoreceptor drum 201 and is axially extended. The two-dimensional liquid crystal shutter array 232 having a length similar to the fluorescent lamp 231 is provided in close proximity to the photoreceptor drum 201, and is formed so that its cross section along an inner-peripheral surface of the photoreceptor drum 201 has an arc-like shape of a substantial semicircle. A light emitted from the fluorescent lamp 231 passes through the two-dimensional liquid crystal shutter array 232, the transparent carrier 201*a* and the transparent conductive layer 201*b* of the photoreceptor drum 201 so as to be collected on the photoconductive layer 201*c*.

The two-dimensional liquid crystal shutter array 232 is suitable for forming an image with high quality, so an image which is intermingled with a photograph can be output by using the two-dimensional liquid crystal shutter array 232. Here, as to another method of outputting an image which is intermingled with a photograph, a pseudo half tone process such as a dither process which express half tone is known. However, this process arises a problem of lowering resolution in proportion to increase in a number of tones. On the contrary, in a process using a two-dimensional liquid crystal shutter array, it is checked that half-tone recording with high quality can be carried out without lowering resolution. Moreover, in order to solve the above problem, improvement in recording density is considered, but the image forming apparatus of the present invention adopts a process using the two-dimensional liquid crystal shutter array 232 which can be easily realized.

As to the two-dimensional liquid crystal shutter array 232, its cells can be generously classified into two categories according to an operation for narrowing down a path of a light from a light source; "circular narrowing-down operation cell" which forms a circular light transmitting portion at a square aperture of individual narrowing-down operation cell in the two-dimensional liquid crystal shutter array 232 and "angular narrowing-down operation cell" which forms a rectangular light transmitting portion at a square aperture of individual narrowing-down operation cell in the two-dimensional liquid crystal shutter array 232. Furthermore, the angular narrowing-down operation cell can be classified into a both-side narrowing-down operation cell and an one-side narrowing-down operation cell. In the circular narrowing-down operation, four wires are required per one picture element and divisional driving is impossible. This is disadvantageous to a printer head having a great number of driving circuits from a viewpoint of costs. Moreover, although the divisional driving is possible in the both-side narrowing-down operation, it has a shortcoming that the narrowing-down operation speed in the case of a low aperture ratio is slow. On the contrary, in one-side narrow-down operation, the divisional driving is possible and also an area of the light transmitting portion can be reduced without slowing down its operation speed. Therefore, as the two-dimensional liquid crystal shutter array 232, one having a circular narrow-down operation cell or a rectangular narrowing-down operation cell, one which performs a both-side narrowing-down operation, or one which performs an one-side narrowing-down operation can be adopted, but here, the cell which performs the one-side narrowing-down operation capable of reacting to high-speed processes.

Figure 16:
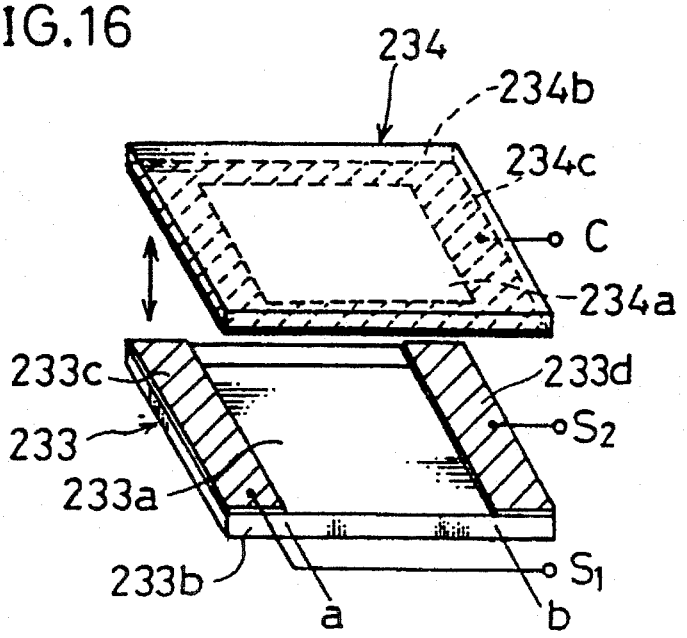

First, an arrangement of the aperture narrowing-down operation cell of the two-dimensional liquid crystal shutter array 232 will be explained. As shown in FIG. 16, the aperture narrowing-down operation cell has a basic arrangement which is same as a normal liquid crystal cell, that is, liquid crystal (not shown) is caught between a high-resistance transparent electrically conductive film 233*a* and a low-resistance transparent electrically conductive film 234*a* respectively in two panels 233 and 234. Here, the drawing is an exploded perspective view of the aperture narrowing-down operation cell. The aperture narrowing-down operation cell is arranged so that the high-resistance transparent electrically conductive film 233*a* is provided on the up surface of a flexible base material 233*b* on the down side, and metal electrodes 233*c* and 233*d* are provided on both ends of the high-resistance transparent electrically conductive film 233*a*. Meanwhile, the low-resistance transparent electrically conductive film 234*a* is provided on the down surface of a flexible base material 234*b* on the up side, and a metal electrode 234*c* is provided around the low-resistant transparent electrically conductive film 234*a*.

Figure 17:
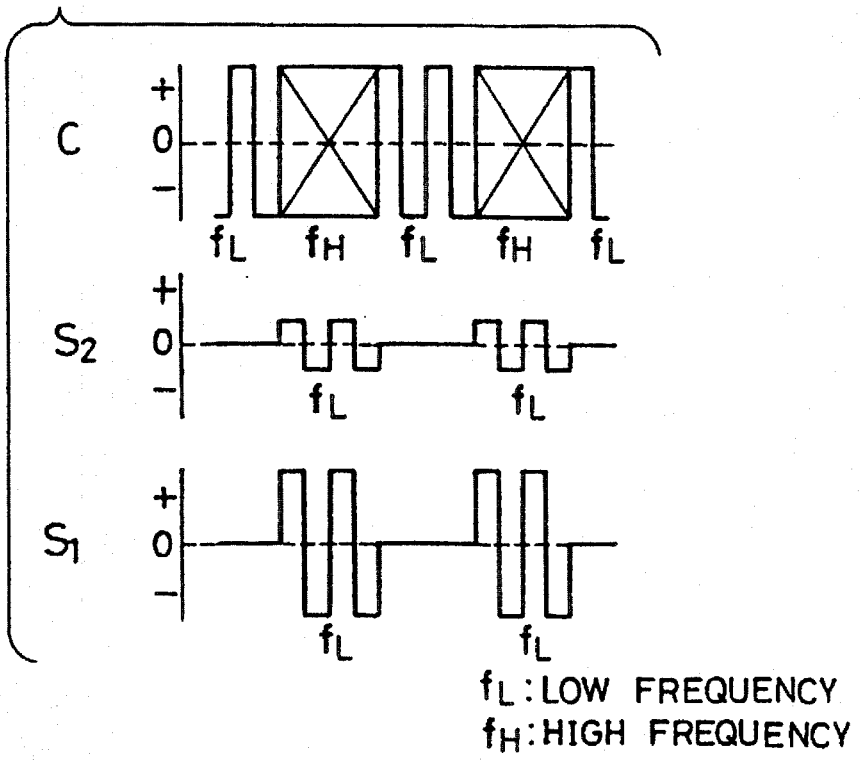
Figure 18A:
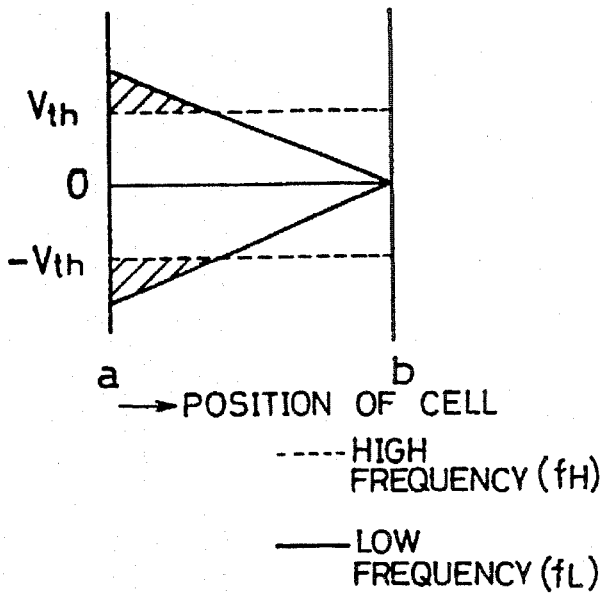
Figure 18B:
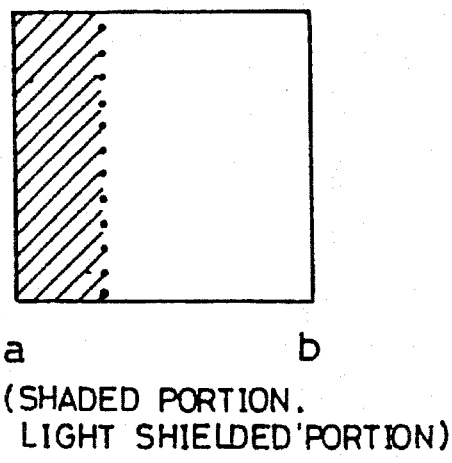

Next, a driving principle of the narrowing-down operation cell will be explained. Basic driving waveforms of driving signals of the narrowing-down operation in the cell is shown in FIG. 17. A waveform of a driving signal C is same as a waveform of open/close operation of two frequency driving. When the electrodes 233*c* and 233*d* are grounded and the driving signal C is applied to the electrode 234*c*, an aperture of the narrowing-operation cell is in light cutting-off state in a range of a low frequency represented by $f_L$, and is in light transmitting state in a range of a high frequency represented by $f_H$. Meanwhile, when at the time of applying the high frequency $f_H$, the low frequency $f_L$ shown in FIG. 17 is simultaneously applied and a voltage difference is provided to the electrodes 233*c* and 233*d* on the panel 233 on down side shown in FIG. 16, a linear voltage distribution represented by solid lines in FIG. 18(*a*) is formed on the high-resistance transparent electrically conductive film 233*a* on the panel 233. Here, broken lines in the drawing represents a threshold voltage Vth which is formed by superposing of the high frequency $f_H$. Moreover, the drawing is an example that a driving signal $S_1$ to be applied to the electrode 233*c* has a voltage which is not less than the threshold voltage Vth and that a driving signal $S_2$ to be applied to the electrode 233*d* is 0V. Positions a and b on a horizontal axis shown in the drawing coincide with positions a and b marked on both the ends of the high-resistance transparent electrically conductive film 233*a* on the panel 233 shown in FIG. 16. Moreover, in FIG. 18(*a*), a left side where the low frequency $f_L$ shown by solid lines is higher than the threshold voltage Vth shown by broken lines is in the light cutting-off state, meanwhile a right side where the low frequency $f_L$ is lower than the threshold voltage Vth is in the light transmitting state. As a result, a light transmitting portion and a light cutting-off portion are formed at one aperture, thereby obtaining one-side narrowing-down state shown in FIG. 18(*b*).

An aperture ratio in the above narrowing-down operation can be controlled by change in a voltage of driving signals $S_1$ and $S_2$ with the low frequency $f_L$ to be applied to the electrodes 233*c* and 233*d*. In this case, when a difference in the voltage of the driving signals $S_1$ and $S_2$ with the low frequency $f_L$ is changed, linear inclines of the voltage represented by the solid lines in FIG. 18(*a*) change, so intersections of the voltage and the threshold voltage Vth represented by broken lines shift. As a result, ranges of the light transmitting portion and the light cutting-off section change, thereby making it possible to narrow down the aperture to a desired size. Moreover, in order to open the aperture when the driving signal c has the high frequency $f_H$, the electrodes 233*c* and 233*d* are grounded, and meanwhile in order to close, the electrodes 233*c* and 233*d* has the low frequency $f_L$ not less than the threshold voltage Vth. With a combination of the above, when the driving signal C with the high frequency $f_H$ is applied to the electrodes 233*c* and 233*d*, the aperture can be in a desired state; open state, narrowed-down state or closed state.

Figure 19A:
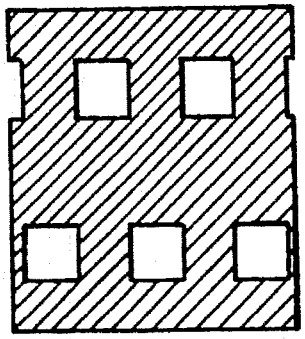
Figure 19B:
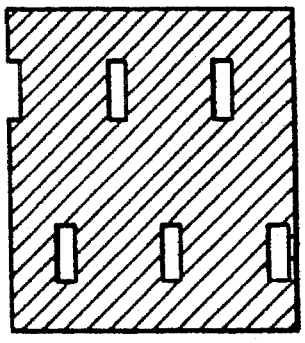

Next, an optical response to the aperture narrowing-down operation will be explained. As one example, FIGS. 19(*a*) and 19(*b*) shows a state of the aperture when the two-dimensional liquid crystal shutter array 232 is driven by using a threshold signal of open/close operation in which a number of repeatabilities is 500 Hz. In the case where the driving signals $S_1$ and $S_2$ are 0V, as shown in FIG. 19(*a*), the aperture is completely opened, and in the case where the driving signal $S_1$ is 30V and the driving signal $S_2$ is 0V, as shown in FIG. 19(*b*), the aperture is narrowed down. In FIG. 19(*b*), although clearly rectangular apertures are drawn in the narrowed-down state, actually, an amount of a light is gradually decreased near a boundary of the light transmitting portion and the light cutting-off portion.

Figure 20:
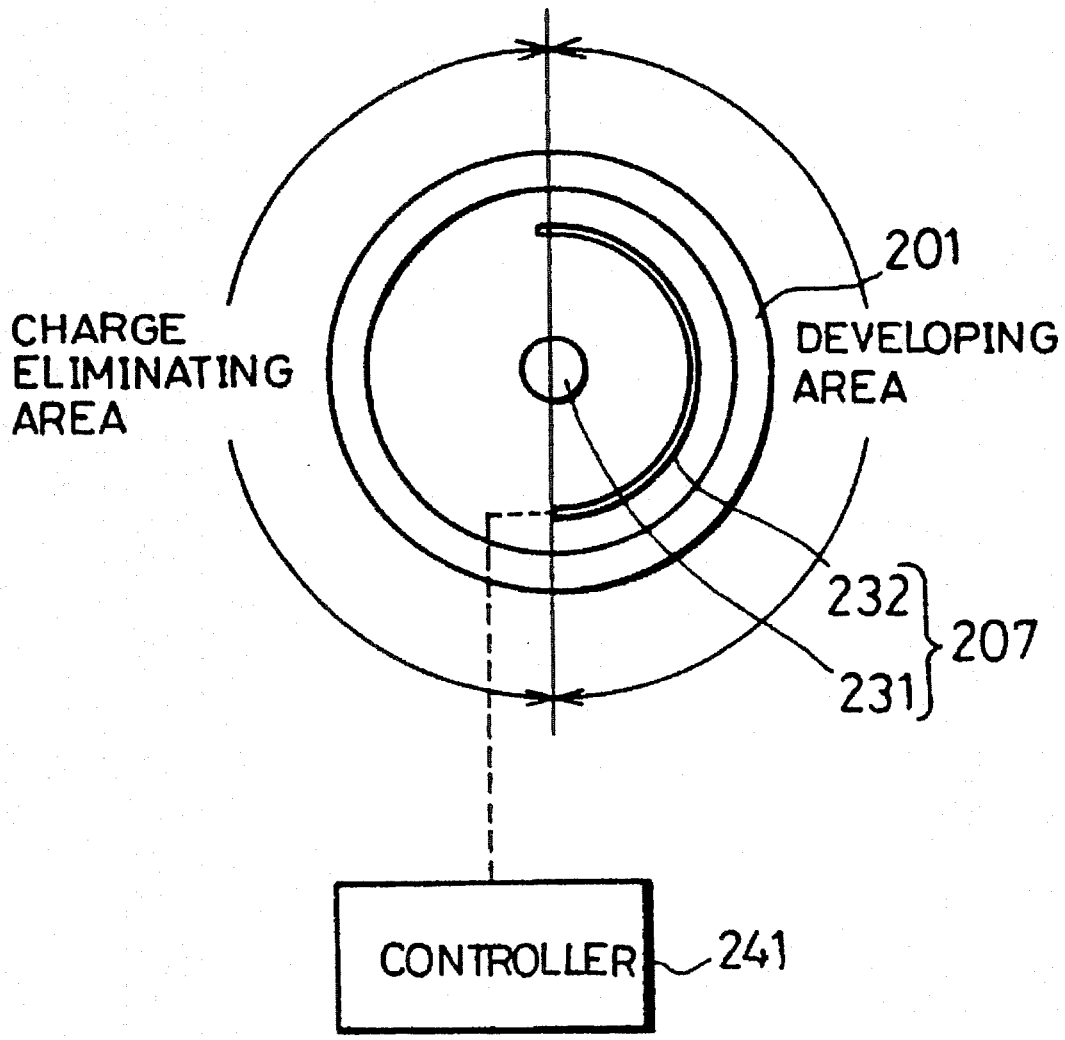
Figure 21:
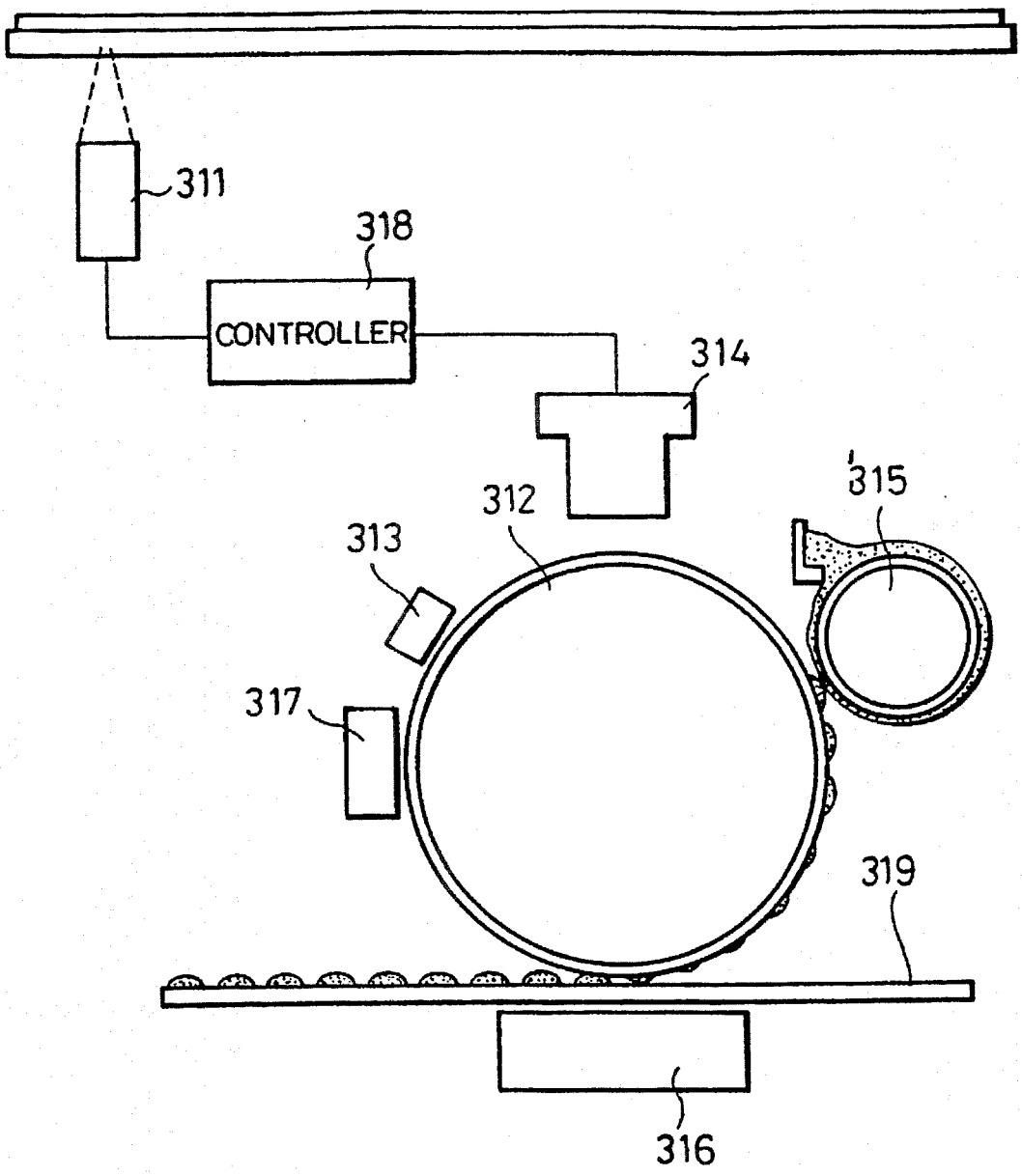
FIGS. 21 through 29 are drawing which shows conventional arts.
Figure 22:
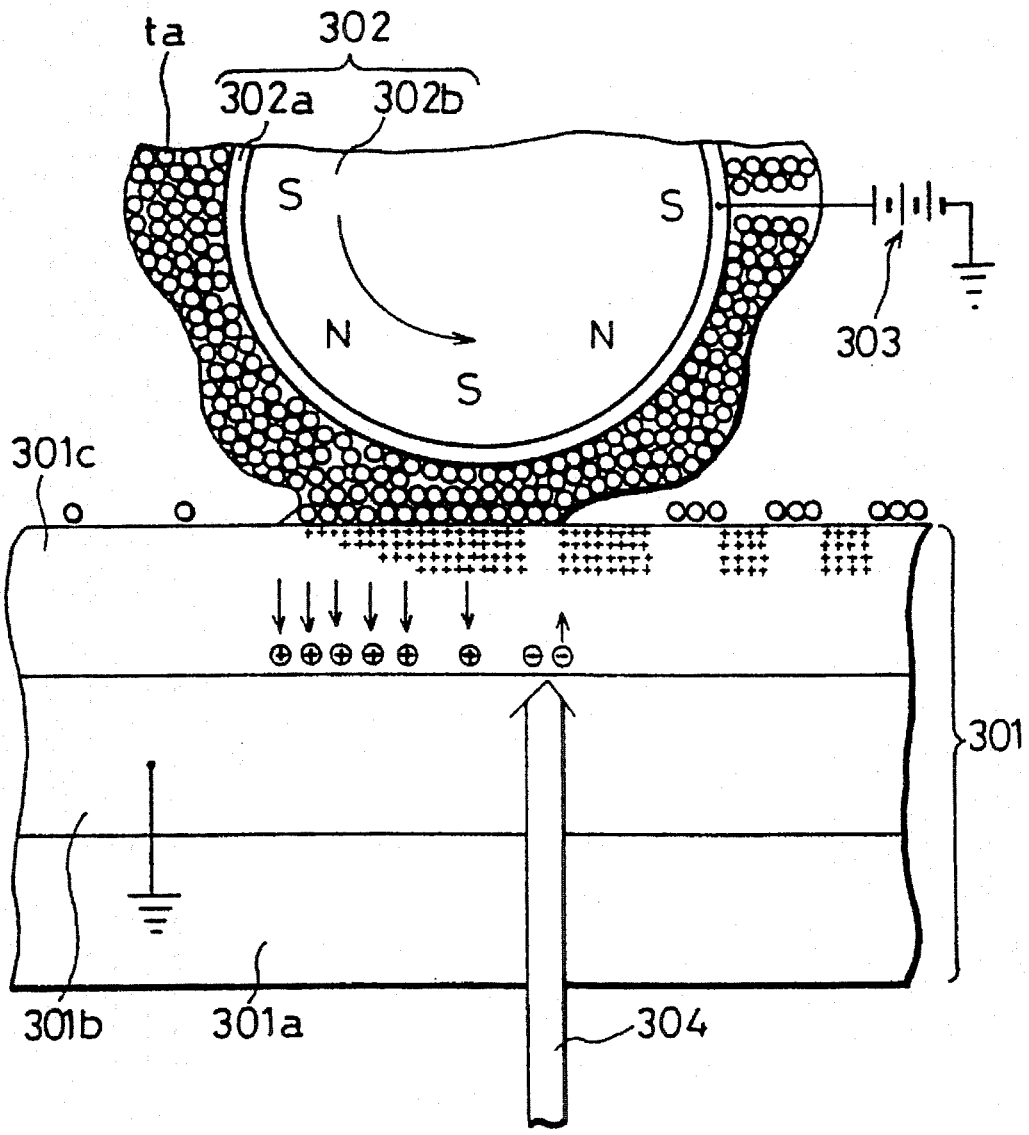
Figure 23:
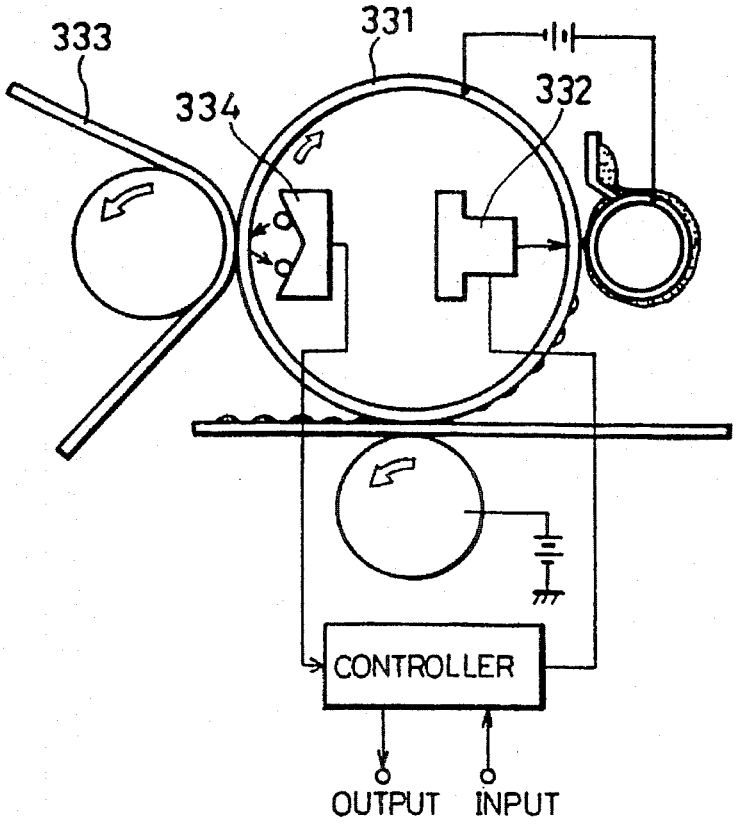
Figure 24:
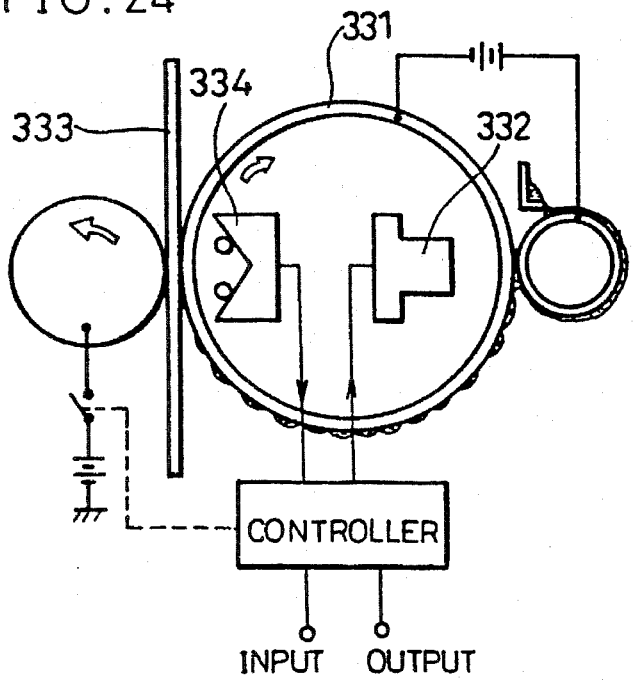
Figure 25:
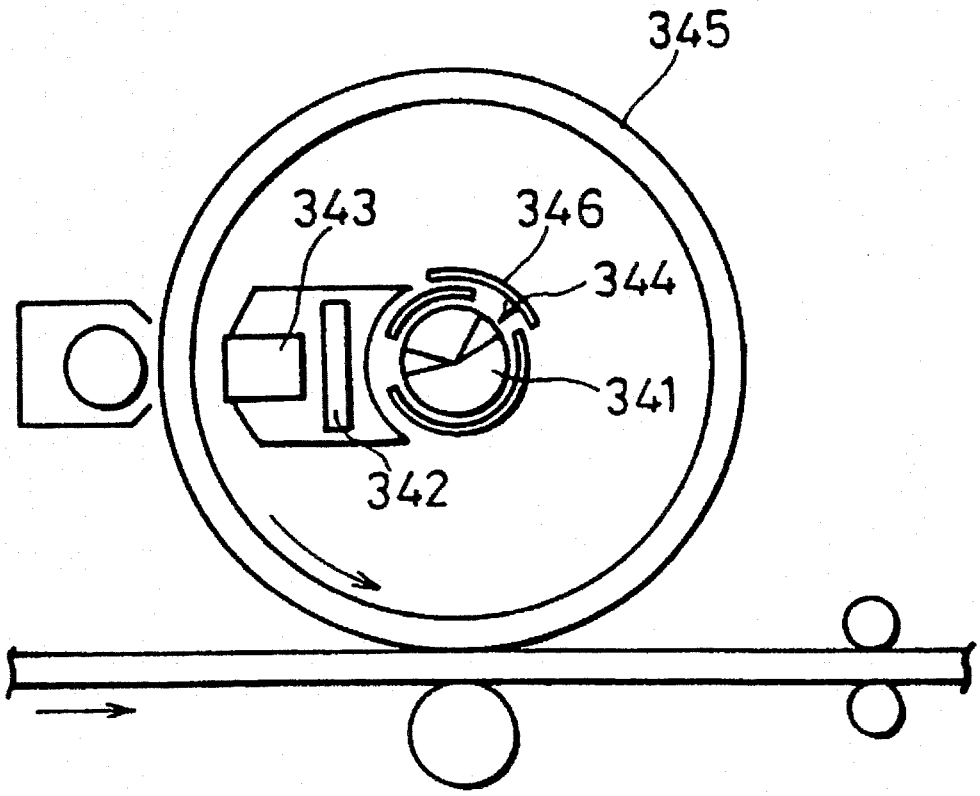
Figure 26:
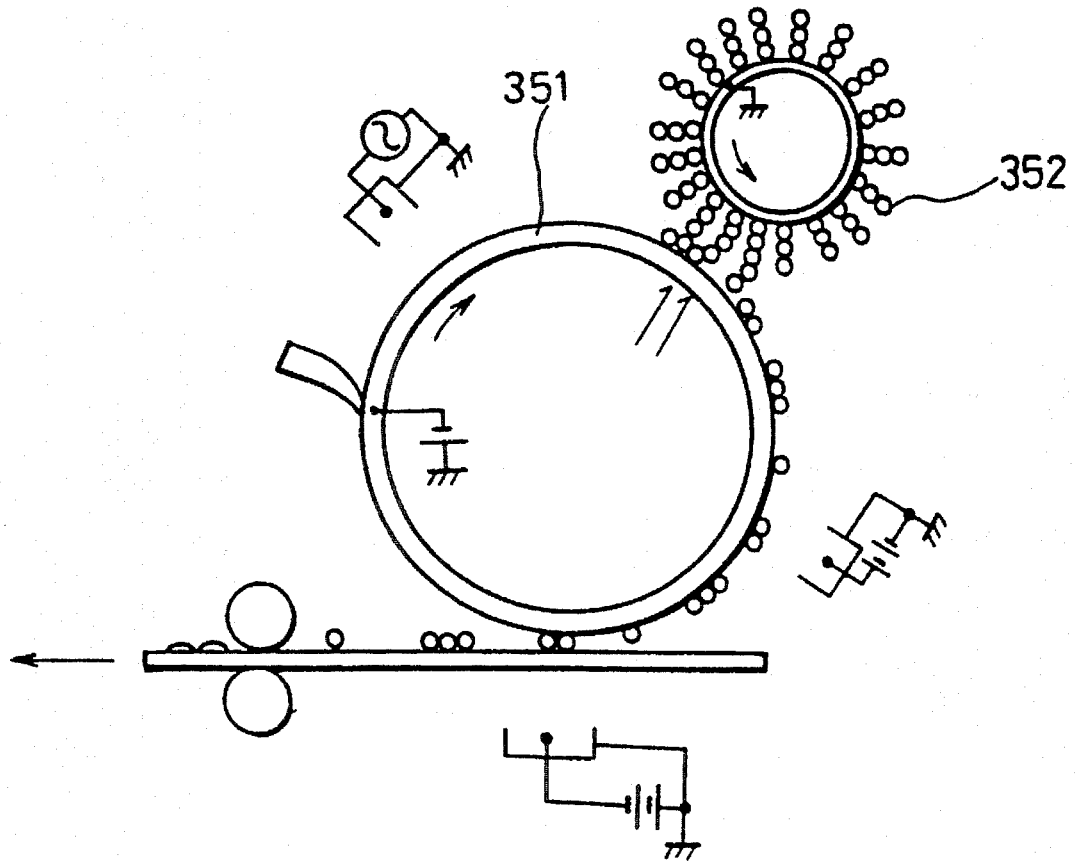
Figure 27A:
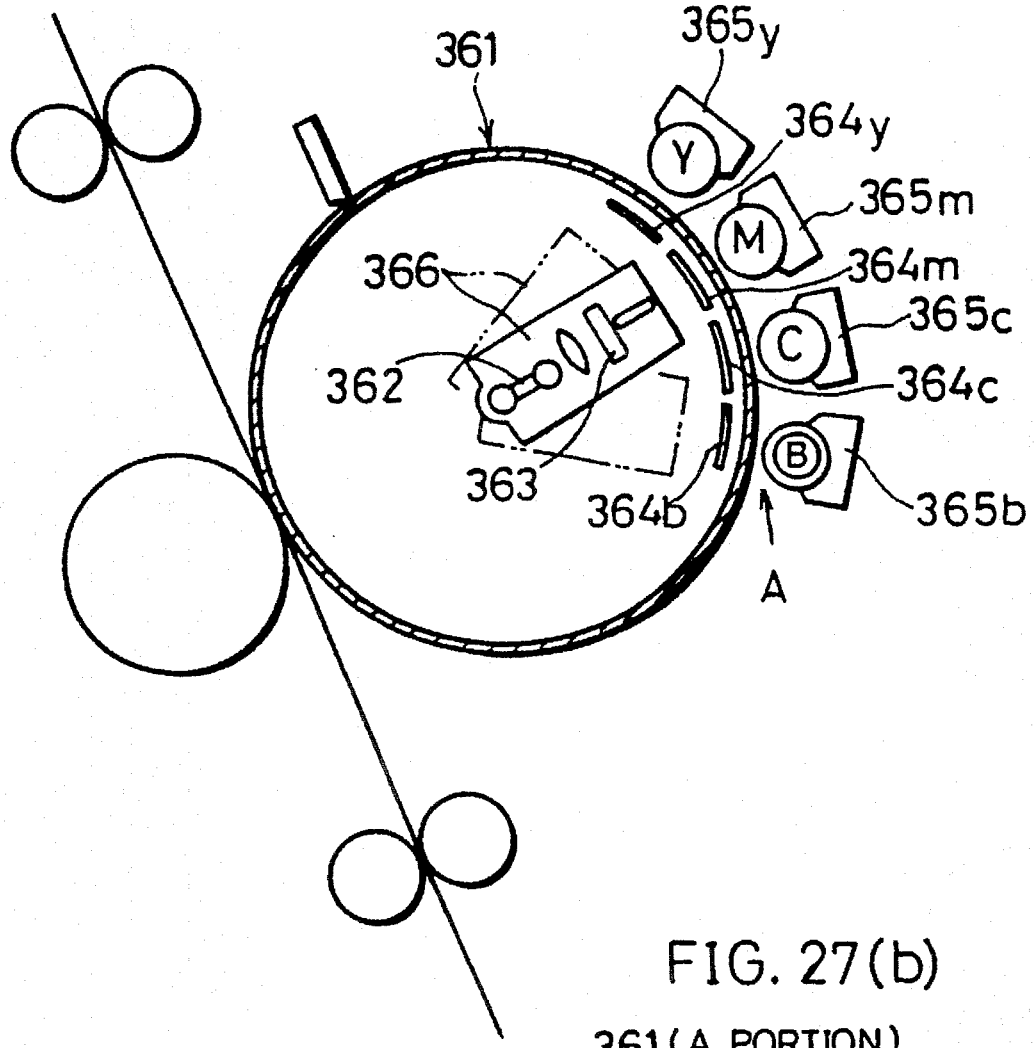
Figure 27B:
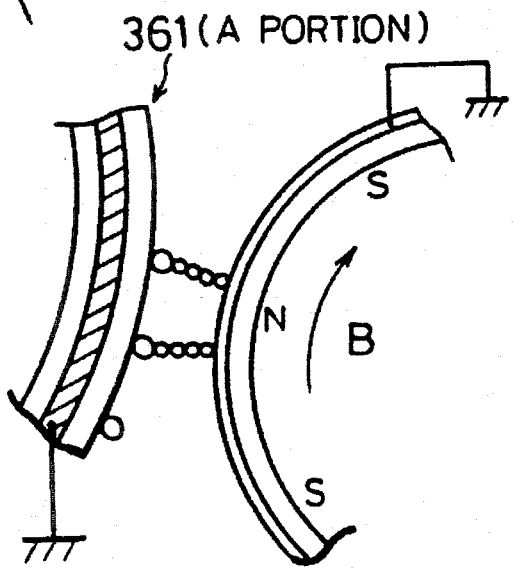
Figure 28:
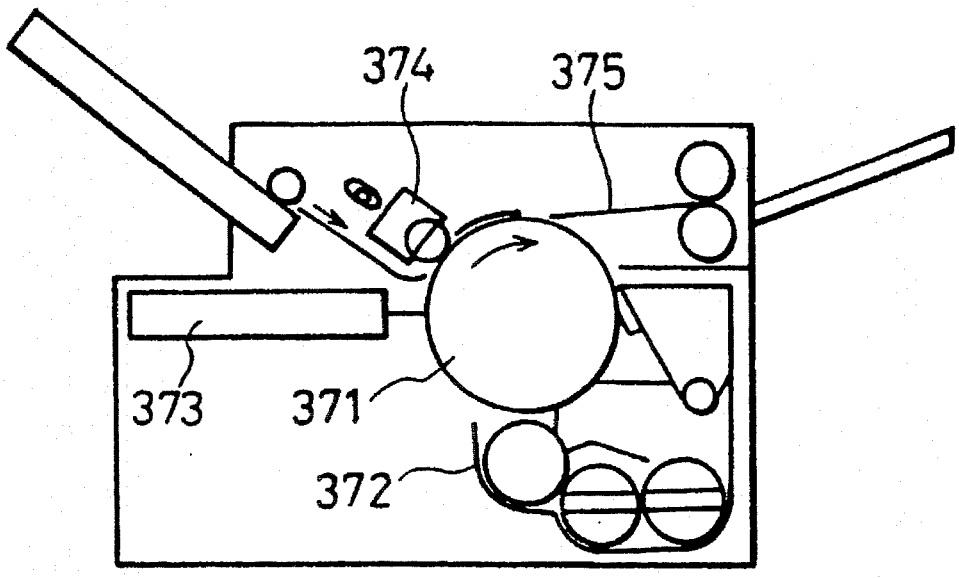
Figure 29:
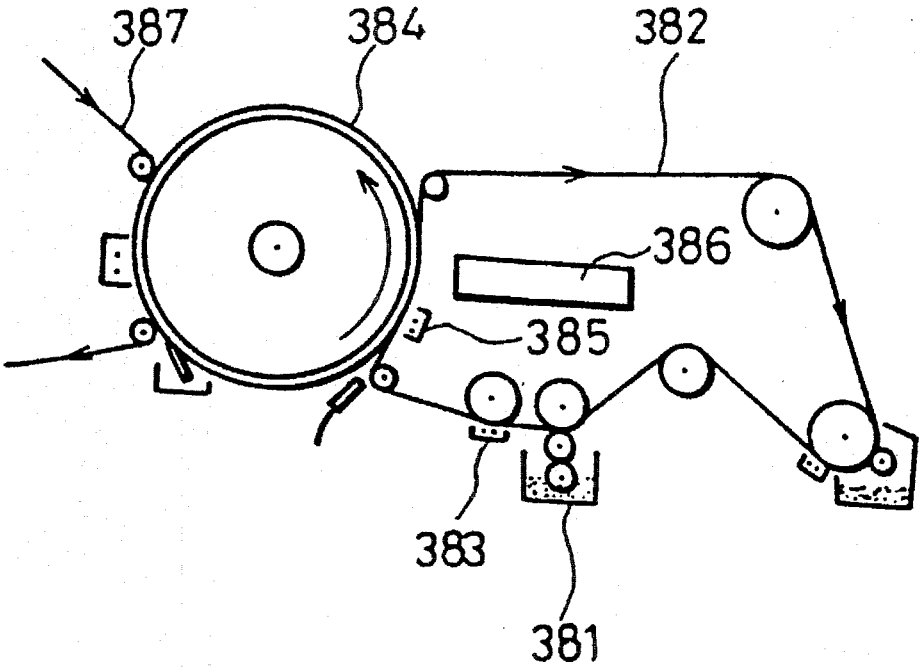

As shown in FIG. 20, a control unit 241 as controlling means for control the driving according to an image signal is connected to the two-dimensional liquid crystal shutter array 232.

Next, an operation of the image forming apparatus having the above arrangement will be explained.

As shown in FIG. 13, first, when a piece of paper P, not shown, is sent from the sheet feed opening by sheet feeding means, not shown, a front end of the paper P pushes up the paper insertion detecting actuator 216 so that the paper insertion detecting switch 217 detects feeding of the paper P and transmits a paper insertion detecting signal to the stepping motor 213. Then, the stepping motor 213 as a driving source is driven so as to rotate.

Next, the rotation of the stepping motor 213 is transmitted to the feeding roller 218 through a rotation transmitting system, not shown, so that the feeding roller 218 is rotated. The paper P is carried to the register roller 219 by the rotation of the feeding roller 218.

When the rotation of the register roller 219 is stopped by controlling a register solenoid 220, the paper P which has been carried to the register roller 219 is temporarily stopped. At this time, a back end of the paper P is caught between the feeding rollers 218•218, and the feeding rollers 218•218 slides on the both surface of the paper P when carrying of the paper P is stopped because resistance on a surface of the rollers is low.

Next, the conductive magnetic toner Ta is fed from the developer unit 202 onto the photoreceptor 201, and the photoreceptor 201 is exposed by the exposing unit 207 so that a toner image by the conductive magnetic toner Ta is formed on the photoreceptor 201 through image writing process.

When a voltage with polarity opposite to an injected charge of the toner image is applied to the transfer roller 209, the toner image is transferred onto the dielectric belt 208 by the pressed contact portion of the photoreceptor 201 and the transfer roller 209 through the dielectric belt 208. Meanwhile, when a signal is transmitted from the CPU (Central Processing Unit) of an engine controller, not shown, to the register solenoid 220 so that the toner image on the dielectric belt 208 fits to the paper P at the pressed contact portion of the dielectric belt 208 and the pressurizing roller 212 above the heater 210, the rotation stopped state of the register roller 219 is released, and the paper P is carried to the pressed contact portion of the dielectric belt 208 and the pressurizing roller 212.

When the dielectric belt 208 on which the toner image has been transferred and the sheet P are carried between the heater 210 and the pressurizing roller 212 with them superimposed each other, the toner image is simultaneously transferred and fixed on the paper P. In other words, when the paper P is sent out with it pressed between the dielectric belt 208 and the pressurizing roller 212, the surface of the dielectric belt 208 has excellent release characteristics to the conductive magnetic toner Ta which has been heated and fused by the heater 210 compared to the paper P, so the conductive magnetic toner Ta on the dielectric belt 208 is mostly transferred onto and fixed on the paper P.

Thereafter, the paper P where the toner image has been transferred and fixed pushes up the paper discharge detecting actuator 223 so as to be discharged through the paper discharge opening by the rotation of the discharge roller 225. After prescribed time when the paper insertion detecting signal from the paper insertion detecting switch 217 and the paper discharge detecting signal from the paper discharge detecting switch 224 are not detected, electrical energizing between the heater 210 and the heating resistor 210*a* and the driving of the stepping motor 213 are stopped, so a series of operations are completed.

As mentioned above, since in the image forming apparatus of the present embodiment, the exposing unit 207 includes the fluorescent lamp 231 which is a cylindrical light source provided at the axis position where the photoreceptor 201 rotates and the two-dimensional liquid crystal shutter array 232, which is curved like an arc along the inner peripheral surface of the photoreceptor 201 and which is extended in direction of the inner peripheral surface, quality of an image can be improved without arising a problem of lowering costs.

In other words, if the two-dimensional liquid crystal shutter array 232 is plain, a distance from a central portion of the two-dimensional liquid crystal shutter array 232 to an inner surface of the photoreceptor 201 are different from a distance from an end of the two-dimensional liquid crystal shutter array 232 to the inner surface of the photoreceptor 201 in direction in which the cylindrical photoreceptor 201 rotates. For this reason, since a spot diameter on the photoreceptor 201 of a light from the fluorescent lamp 231 which has passed through the center of the two-dimensional liquid crystal shutter array 232 is different from a spot diameter of a light which has passed through the end portion of the two-dimensional liquid crystal shutter array, there is possibility of remarkable deterioration in quality of an image. In order to solve this problem, compensation by an optical system, etc. for equalizing the spot diameters is required, thereby arising a problem of rise in costs. On the contrary, with the arrangement of the image forming apparatus of the present embodiment, since the distance from the center of the two-dimensional liquid crystal shutter array 232 to the inner surface of the photoreceptor 201 is equal to the distance from the end portion of the two-dimensional liquid crystal shutter array 232 to the inner surface of the photoreceptor 201, there does not arise the above problem. Therefore, quality of an image can be improved without causing rise in costs.

In addition, in the image forming apparatus of the present embodiment, since the exposing unit 207 includes the two-dimensional liquid crystal shutter array 232, not only process speed can be greatly improved but also resolution in vertical scanning direction can be improved very easily.

In other words, in the case where an one-dimensional liquid crystal shutter array is used instead of the two-dimensional liquid crystal shutter array 232, there exist only one row of liquid crystal cells in the vertical scanning direction which is a rotating direction of the photoreceptor 201, complicated control is required in order to obtain excellent resolution in the vertical scanning direction, and furthermore, there are limitations of improvement in the resolution. On the contrary, in the case where the two-dimensional liquid crystal shutter array is used, since a plurality of liquid crystal cells exist in the vertical scanning direction, control for obtaining excellent resolution in the vertical scanning direction is easy, and its process speed can be greatly improved.

In addition, as shown in FIG. 20, in the image forming apparatus of the present embodiment, an area in the fluorescent lamp 231 which is not opposed to the two-dimensional liquid crystal shutter array 232 can be used as a charge eliminating area of the fluorescent lamp 231 or the charge eliminating and cleaning area.

In addition, in the image forming apparatus of the present embodiment, the toner image, which has been developed on photoreceptor 201 in the above manner, is simultaneously transferred onto and fixed on a recording material through the dielectric belt 208 by heating by the heater 210 and pressurization by the pressurizing roller 212.

For this reason, it is not necessary that a material of a recording material where a toner image is transferred and fixed is limited to a particular material, and it is always possible to that a stable toner image is transfer onto and fix on a recording material without being influenced by change in environment. Moreover, since a toner image is simultaneously transferred onto and fixed on a recording material, a recording material where a toner image has not been fixed is not carried, thereby making it possible to freely design carrying of a recording material.

Furthermore, since components having a substantially same period of life as of the photoreceptor 201, the dielectric belt 208 and the heater 210 are arranged such that the components constitute one unit in the image forming apparatus, it is possible to efficiently improve maintainability.

Here, the present invention is not limited to the above embodiment, so the embodiment can be variously changed within scope of the present invention. For example, in the above embodiment, as a photoreceptor where a toner image is developed, the photoreceptor 201, which is arranged such that the transparent conductive layer 201*b* and the photoconductive layer 201*c* are formed on the transparent carrier 201*a* in this order, is used, but it is not particularly limited to this configuration and arrangement. Therefore, a photoreceptor may be arranged such that the conductive magnetic toner Ta is made contact with one portion of the photoreceptor from one side, the exposing unit 207 is positioned on its opposite portion and that an toner image can be transferred onto a portion other than the above two. As to a shape, a board-like photoreceptor in the case where the photoreceptor is made of an organic material, or a belt-like photoreceptor may be adopted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus carrying out simultaneous charge-expose-development process, which exposes a transparent image carrier from an inside of said image carrier on an opposite side to a developing side so as to form a visible image on a surface of said image carrier, comprising:

said image carrier formed such that at least a transparent conductive layer is formed on a transparent base;

developing means for supplying a developer to a surface of a transparent conductive layer side of said image carrier, said developing means being provided on the transparent conductive layer side of said image carrier;

an optical head unit provided on a transparent base side of said image carrier; and control means for controlling an operation of said optical head unit, wherein said optical head unit includes:

exposing means for irradiating a light around the developer supplied position from the transparent base side of said image carrier, said exposing means being provided oppositely to said developing means across said image carrier; and information reading means for irradiating a light on a document positioned on the transparent conductive layer side so as to read a document image using a reflected light from the document, said exposing means being integral with said information reading means, wherein said optical head unit further includes:

a common light source which is commonly used as a light source to the above two means which are integral with each other;

a first liquid crystal shutter array for opening and closing an optical path of said common light source in direction of said image carrier so that a light of said common light source is used as a light of said exposing means; and a second liquid crystal shutter array for opening and closing the optical path of said common light source in the direction of said image carrier so that the light of said common light source is used as a light of said information reading means, wherein said control means controls open/close operation of said first liquid crystal shutter array of said exposing means according to an image signal, and controls said first and second liquid crystal shutter arrays so that said second liquid crystal shutter array of said information reading means is closed when said exposing means operates and that said first liquid crystal shutter array of said exposing means is closed when said information reading means operates.

2. The image forming apparatus as defined in claim 1, wherein said optical head unit further includes charge eliminating means for irradiating a light on said image carrier so as to eliminate charges therefrom, said charge eliminating means being integral with said exposing means and said information reading means, said common light source being commonly used as a light source of said charge eliminating means, said charge eliminating means including a third shutter array for opening and closing the optical path of said common light source in the direction of said image carrier so that the light of said common light source is used as a light of said charge eliminating means, wherein said control means controls the liquid crystal shutter arrays so that the first liquid crystal shutter array as well as the third liquid crystal shutter array are closed when said information reading means operates.

3. The image forming apparatus as defined in claim 1, wherein said image carrier is formed so as to have a cylindrical shape, and said developing means are provided outside said image carrier and said optical head unit inside said image carrier.

4. The image forming apparatus as defined in claim 1, wherein said information reading means includes:

light receiving means for receiving the reflected light from the document; and an optical fiber array for transmitting the light which has passed through said second liquid crystal shutter array to a side of said light receiving means while avoiding a position where said light receiving means is provided, wherein said information reading means irradiates the light which has been emitted from said optical fiber array on the document.

5. The image forming apparatus as defined in claim 1, wherein said information reading means further includes a filter for transmitting only a light with wavelength which is hardly absorbed in said image carrier, said filter being provided on an optical path of said common light source in direction of said image carrier.

6. The image forming apparatus as defined in claim 1, wherein, said image carrier is formed such that the transparent conductive layer and the photoconductive layer are formed on the transparent base in this order, said developing means supplies conductive magnetic toner as the developer to the photoconductive layer on the surface of said image carrier, said developing means including:

toner holding means with conductive characteristics for making the conductive magnetic toner contact with the surface of said image carrier while holding the conductive magnetic toner; and developing bias applying means for applying a developing bias across the transparent conductive layer of said image carrier and said toner holding means.

7. The image forming apparatus as defined in claim 6, wherein, the photoconductive layer of said image carrier includes a hydrogenated silicon film with optical band gap of 1.75 eV, said information reading means includes an interference filter with central wavelength of 800 nm for transmitting only a light with wavelength which is hardly absorbed in said image carrier, said interference filter being provided on the optical path of said common light source in the direction of said image carrier.

8. The image forming apparatus as defined in claim 6, wherein, the photoconductive layer of said image carrier is formed such that a charge generating layer using fluorenone disazo pigment as a charge generating material and a charge transport layer using α-phenyl stilbene compound as a charge transport material are formed, said information reading means includes an interference filter with central wavelength of 750 nm for transmitting only a light with wavelength which is hardly absorbed in said image carrier, said interference filter being provided on an optical path of said common light source in direction of said image carrier.

9. The image forming apparatus as defined in claim 1, wherein, said image carrier is formed such that a transparent conductive layer and a dielectric layer are formed on a transparent base in this order, said developing means supplies photoconductive toner as the developer to the dielectric layer on the surface of said image carrier, said developing means including:

a dielectric belt sliding the surface of said image carrier;

coating means for coating a surface on a contact side of said dielectric belt with the surface of said image carrier with the photoconductive toner dispersed in dielectric liquid;

an electrode positioned oppositely to said image carrier across said dielectric belt;

pre-charging means for uniformly charging the photoconductive toner coated to surface of said dielectric belt just before the photoconductive toner reaches said image carrier; and developing bias applying means for applying a developing bias voltage across the transparent conductive layer of said image carrier and said electrode.

10. The image forming apparatus as defined in claim 9, wherein, the developer to be supplied to the surface of said image carrier by said developing means is in a state that photoconductive toner having plural colors in which photosensitive characteristics vary with a wavelength of a light is mixed up, a plurality of said first liquid crystal shutter arrays of said exposing means exist accordingly to each color of the photoconductive toner, color filters for selectively transmitting a light with wavelength which is absorbed by the photoconductive toner having each color being provided on the optical path opened and closed by each of said first liquid crystal shutter array.

11. The image forming apparatus as defined in claim 1, wherein, said image carrier is formed such that the transparent conductive layer is formed on the transparent base, said developing means supplies photoconductive toner as the developer to the transparent conductive layer on the surface of said image carrier, said developing means includes:

toner holding means with conductive characteristics for making the photoconductive toner contact with the surface of said image carrier while holding the photoconductive toner;

charging means for uniformly charging the photoconductive toner held by said toner holding means; and a developing bias applying means for applying a developing bias voltage across the transparent conductive layer of said image carrier and said toner holding means.

12. The image forming apparatus as defined in claim 11, wherein, said toner holding means has elasticity and a roller-like shape, rotating in a prescribed direction, said charging means includes a blade for controlling a thickness of the photoconductive toner held on the surface of said toner holding means, and blade voltage applying means for applying a voltage to the blade.

13. The image forming apparatus as defined in claim 11, wherein, the developer to be supplied to the surface of said image carrier by said developing means is in a state that photoconductive toner having plural colors in which photosensitive characteristics vary with a wavelength of a light is mixed up, a plurality of said first liquid crystal shutter arrays of said exposing means exist accordingly to each color of the photoconductive toner, color filters for selectively transmitting a light with wavelength which is absorbed by the photoconductive toner of each color being provided on the optical path opened and closed by each of said first liquid crystal shutter array.

14. The image forming apparatus as defined in claim 1, wherein said common light source is a fluorescent lamp.

15. The image forming apparatus as defined in claim 1, wherein said common light source is a halogen lamp.

16. The image forming apparatus as defined in claim 1, wherein said optical head unit includes a body of equipment for covering a portion other than said first and second liquid crystal shutter arrays so that the light of said common light source is prevented from leaking from the portion other than said first and second liquid crystal shutter arrays to the outside.

17. An image forming apparatus carrying out simultaneous charge-expose-development process for exposing a light transmitting image carrier from an inside of said image carrier on an opposite side to a developing side so as to form a visible image on a surface of said image carrier, comprising:

said image carrier formed cylindrically such that at least a transparent conductive layer is formed on a transparent base;

developing means for supplying a developer to the surface of said image carrier, said developing means being provided outside said image carrier;

exposing means for irradiating a light around the developer supplied position from inside of said image carrier, said exposing means being provided inside said image carrier; and control means for controlling an operation of said exposing means, wherein said exposing means includes a cylindrical light source provided at an axis position where said image carrier rotates and a two-dimensional liquid crystal shutter array which is curved like a cylindrical surface and extended along an inner peripheral surface of said image carrier and is extended in the inner peripheral direction, wherein said control means controls open/close state of each liquid crystal cell of said two-dimensional liquid crystal shutter array according to an image signal.

18. The image forming apparatus as defined in claim 17, wherein the liquid crystal cell of said two-dimensional liquid crystal shutter array performs one-side narrowing-down operation.

19. The image forming apparatus as defined in claim 18, wherein, the liquid crystal cell includes:

a first panel in which a low-resistance transparent electrically conductive film is formed on a substrate and a first electrode is formed around the low-resistance transparent electrically conductive film; and a second panel in which a high-resistance transparent electrically conductive film is formed on a substrate and a second and a third electrodes are formed on the both ends of the high-resistance transparent electrically conductive film, the liquid crystal cell being arranged such that the low-resistance transparent electrically conductive film and the high-resistance transparent electrically conductive film are positioned oppositely to each other and that liquid crystal is put between the first panel and the second panel, wherein said control means controls open/close operation of the liquid crystal cell while switching a frequency of a signal to be applied to the first electrode to high frequency or to low frequency and controls an aperture ratio of the liquid crystal cell by changing a difference in a voltage between a signal with low frequency applied to the second electrode and a signal with low frequency applied to the third electrode when a signal with high frequency is applied to the first electrode.

* * * * *